US007291399B2

(12) United States Patent
Kaplan et al.

(10) Patent No.: US 7,291,399 B2
(45) Date of Patent: Nov. 6, 2007

(54) FUSER FLUID COMPOSITIONS

(75) Inventors: Samuel Kaplan, Walworth, NY (US); Santokh Badesha, Pittsford, NY (US); Mark Amico, Pittsford, NY (US); Alexander Klymachyov, Webster, NY (US); Johan Marien van der Werf, Overloon (NL); Peter MHM Peeters, Bergen (NL); John Connor, Berkshire (GB); Peter Karran, Cambridgeshire (GB); Louis D. Fratangelo, Fairport, NY (US); Mark John Lillie, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 518 days.

(21) Appl. No.: 10/821,760

(22) Filed: Apr. 9, 2004

(65) Prior Publication Data

US 2005/0048294 A1 Mar. 3, 2005

Related U.S. Application Data

(60) Provisional application No. 60/498,752, filed on Aug. 30, 2003.

(51) Int. Cl.
*G03G 13/20* (2006.01)

(52) U.S. Cl. ..... 428/447; 428/421; 430/124.35; 399/333; 492/56

(58) Field of Classification Search ..... 428/447, 428/421; 430/124, 124.35; 399/333; 492/56
See application file for complete search history.

(56) References Cited

U.S. PATENT DOCUMENTS 3,002,927 A 10/1961 Awe et al.
3,590,000 A 6/1971 Palermiti et al.
3,731,358 A 5/1973 Artl
4,011,362 A 3/1977 Stewart
4,029,827 A 6/1977 Imperial et al.
4,046,795 A 9/1977 Martin
4,101,686 A 7/1978 Strella et al.
4,146,659 A 3/1979 Swift et al.
4,150,181 A 4/1979 Smith
4,185,140 A 1/1980 Strella et al.
4,298,672 A 11/1981 Lu
4,338,390 A 7/1982 Lu
4,515,884 A 5/1985 Field et al.

(Continued)

FOREIGN PATENT DOCUMENTS

EP 0 662 645 7/1994

(Continued)

OTHER PUBLICATIONS

European Search Report dated Nov. 19, 2004.

*Primary Examiner*—Mark A. Chapman
(74) *Attorney, Agent, or Firm*—Eugene O. Palazzo; Fay Sharpe LLP

(57) ABSTRACT

Disclosed is a fuser member comprising a substrate, a layer thereover comprising a polymer or an elastomer, and, on the layer, a coating including mercapto- and amino-functionalities comprising from about 0.05 mole percent to about 1.00 mole percent mercapto groups and from about 0.0001 mole percent to about 0.06 mole percent amino groups, wherein the ratio of mercapto to amino mole percent values is at least 2. The layer preferably is a fluoropolymer or fluoroelastomer filled with a metal oxide (CuO, $Al_2O_3$, etc.).

45 Claims, 4 Drawing Sheets

U.S. PATENT DOCUMENTS

| | | | |
|---|---|---|---|
| 4,558,108 | A | 12/1985 | Alexandru et al. |
| 4,968,766 | A | 11/1990 | Kendziorski |
| 5,157,445 | A | 10/1992 | Shoji et al. |
| 5,166,031 | A | 11/1992 | Badesha et al. |
| 5,227,460 | A | 7/1993 | Mahabadi et al. |
| 5,281,506 | A | 1/1994 | Badesha et al. |
| 5,337,129 | A | 8/1994 | Badesha |
| 5,366,772 | A | 11/1994 | Badesha et al. |
| 5,370,931 | A | 12/1994 | Fratangelo et al. |
| 5,395,725 | A | 3/1995 | Bluett et al. |
| 5,401,570 | A | 3/1995 | Heeks et al. |
| 5,463,009 | A | 10/1995 | Okada et al. |
| 5,486,987 | A | 1/1996 | Fritz, Jr. |
| 5,493,376 | A | 2/1996 | Heeks |
| 5,512,409 | A | 4/1996 | Henry et al. |
| 5,516,361 | A | 5/1996 | Chow et al. |
| 5,531,813 | A | 7/1996 | Henry et al. |
| 5,568,239 | A | 10/1996 | Furukawa et al. |
| 5,624,780 | A | 4/1997 | Nishimori et al. |
| 5,627,000 | A | 5/1997 | Yamazaki et al. |
| 5,636,012 | A | 6/1997 | Uneme et al. |
| 5,641,603 | A | 6/1997 | Yamazaki et al. |
| 5,698,320 | A | 12/1997 | Ebisu et al. |
| 5,716,747 | A | 2/1998 | Uneme et al. |
| 5,747,212 | A | 5/1998 | Kaplan et al. |
| 5,747,214 | A | 5/1998 | Kato et al. |
| 5,778,290 | A | 7/1998 | Badesha et al. |
| 5,864,740 | A | 1/1999 | Heeks et al. |
| 6,183,929 | B1 | 2/2001 | Chow et al. |
| 6,197,989 | B1 | 3/2001 | Furukawa et al. |
| 6,253,055 | B1 | 6/2001 | Badesha et al. |
| 6,261,688 | B1 | 7/2001 | Kaplan et al. |
| 6,365,316 | B1 | 4/2002 | Stamp et al. |
| 6,377,774 | B1 | 4/2002 | Maul et al. |

FOREIGN PATENT DOCUMENTS

| | | |
|---|---|---|
| EP | 0 840 180 | 5/1998 |
| EP | 0 869 406 | 10/1998 |

FIG. 4
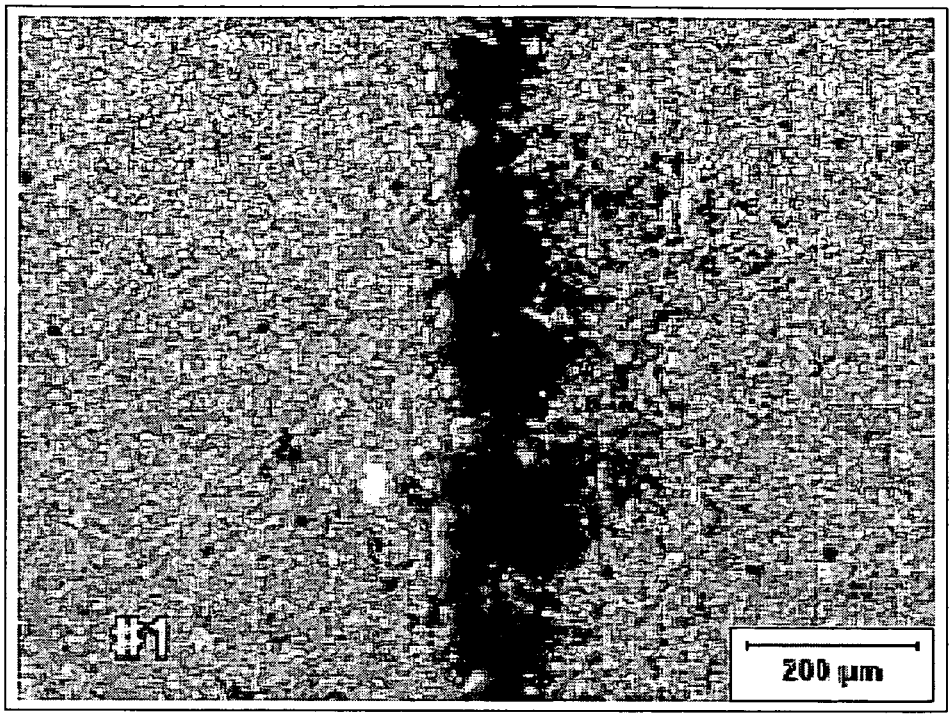
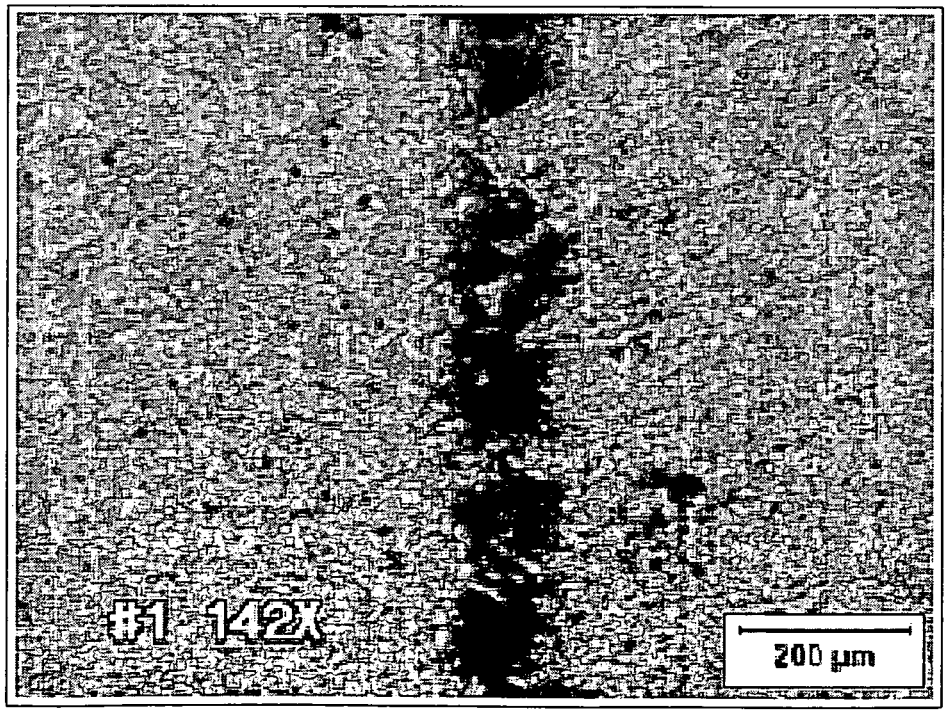
FIG. 5

FIG. 6
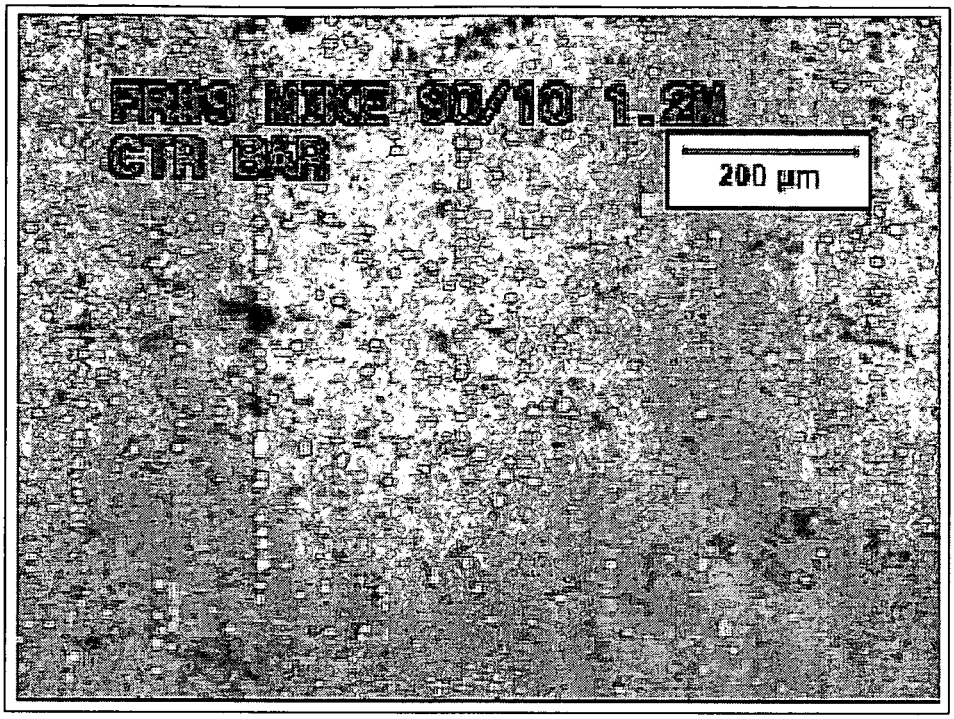
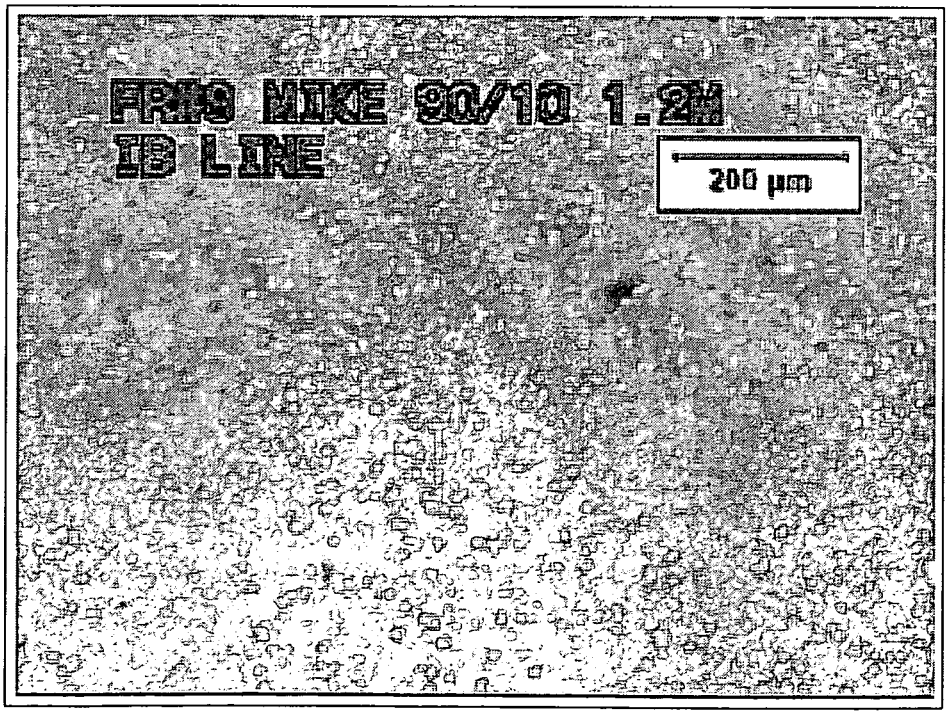
FIG. 7

FUSER FLUID COMPOSITIONS

The present development claims priority from U.S. Provisional Application Ser. No. 60/498,752, filed Aug. 30, 2003.

BACKGROUND

The present disclosure is directed to new compositions, such as fuser fluids, fuser oils or release agents, selected for use during the fusing of electrostatic toner particles. The compositions possess a number of advantages, such as enhancing the release of toner particles, particularly polyester and styrene butadiene based toner particles, from a fuser roll or similar components in various apparatuses such as an electrostatic, especially xerographic, reproducing apparatuses. More particularly, the present disclosure is directed to a mixture of, such as a solution of, mercapto-functional polyorganosiloxanes and amino-functional polyorganosiloxanes, and to fuser members (hard or soft) coated or impregnated therewith, that can exhibit in various embodiments advantages such as enhanced release and extended fuser life and improved paper interactions. A further development disclosed herein is directed to a fuser member comprising a substrate, a polymeric layer thereover, preferably comprising a fluoropolymer or fluoroelastomer, and, on the layer, a coating of an organosiloxane polymer release agent comprising specific amounts of mercapto- and amino-functionalities.

In a typical electrostatographic reproducing apparatus, a light image of an original to be copied is recorded in the form of an electrostatic latent image upon a photosensitive member, and the latent image is subsequently rendered visible by the application of electroscopic thermoplastic resin particles and pigment particles, or toner. The visible toner image is then in a loose powdered form and can be easily disturbed or destroyed. The toner image is usually fixed or fused upon a support, which can be the photosensitive member itself, or some other support sheet such as plain paper.

The use of thermal energy for fixing toner images onto a support member is well known. To fuse toner material onto a support surface permanently by heat, it is usually necessary to elevate the temperature of the toner material to a point at which the constituents of the toner material coalesce. This heating causes the toner to flow to some extent into the fibers or pores of the support member. Through the use of heat and pressure over a given amount of time, the material becomes fixed. Thereafter, as the toner material cools, solidification of the toner material causes the toner to be bonded firmly to the support.

Typically, the thermoplastic resin particles are fused to the substrate by heating to a temperature of from about 90° C. to about 200° C. or higher, depending on the softening range of the particular resin used in the toner. It may be undesirable, however, to increase the temperature of the substrate substantially higher than about 250° C. because of the tendency of the substrate to discolor or convert into fire at such elevated temperatures, particularly when the substrate is paper.

Several approaches to thermal fusing of electroscopic toner images have been described. These methods include providing the application of heat and pressure substantially concurrently by various means, a roll pair maintained in pressure contact, a belt member in pressure contact with a roll, a belt member in pressure contact with a heater, and the like. Heat can be applied by heating one or both of the rolls, plate members, or belt members. Fusing of the toner particles occurs when the proper combination of heat, pressure, and/or contact for the optimum time period are provided. The balancing of these variables to bring about the fusing of the toner particles is well known in the art, and can be adjusted to suit particular machines or process conditions.

During the operation of one fusing system in which heat is applied to cause thermal fusing of the toner particles onto a support, both the toner image and the support are passed through a nip formed between a pair of rolls, plates, belts, or combination thereof. The concurrent transfer of heat and the application of pressure in the nip effects the fusing of the toner image onto the support. It is important in the fusing process that minimal or no offset of the toner particles from the support to the fuser member takes place during normal operations. Toner particles offset onto the fuser member can subsequently transfer to other parts of the machine or onto the support in subsequent copying cycles, thereby increasing the image background, causing inadequate copy quality, causing inferior marks on the copy, or otherwise interfering with the material being copied there as well as causing toner contamination of other parts of the machine. The referred to "hot offset" occurs when the temperature of the toner is increased to a point where the toner particles liquefy and a splitting of the molten toner takes place during the fusing operation with a portion remaining on the fuser member. The hot offset temperature or degradation of the hot offset temperature is a measure of the release properties of the fuser member, and accordingly it is desirable to provide a fusing surface having a low surface energy to provide the necessary release.

To ensure and maintain good release properties of the fuser member, it has become customary to apply release agents to the fuser member during the fusing operation. Typically, these materials are applied as thin films of, for example, silicone oils, such as polydimethyl siloxane (PDMS), or substituted silicone oils, such as amino-substituted oils, mercapto-substituted oils, or the like, to prevent toner offset. In addition, fillers can be added to the outer layers of fuser members to increase the bonding of the fuser oil to the surface of the fuser member, thereby imparting improved release properties.

The use of polymeric release agents having functional groups which interact with a fuser member to form a thermally stable, renewable self-cleaning layer having good release properties for electroscopic thermoplastic resin toners, is described in, for example, U.S. Pat. Nos. 4,029,827, 4,101,686, and 4,185,140, the disclosures of each of which are totally incorporated herein by reference. Disclosed in U.S. Pat. No. 4,029,827 is the use of polyorganosiloxanes having mercapto-functionality as release agents. U.S. Pat. Nos. 4,101,686 and 4,185,140 are directed to polymeric release agents having functional groups such as carboxy, hydroxy, epoxy, amino, isocyanate, thioether, and mercapto groups as release fluids.

It is of value to select the correct combination of fuser surface material, any filler incorporated or contained therein, and fuser oil. Specifically, it is important that the outer layer of the fuser member react sufficiently with the selected fuser oil to obtain sufficient release. As briefly mentioned above, in order to improve the bonding of fuser oils with the outer surface of the fuser member, fillers have been incorporated into or added to the outer surface layer of the fuser members. The use of a filler can aid in decreasing the amount of fusing oil necessary by promoting sufficient bonding of the fuser oil to the outer surface layer of the fusing member. It is important, however, that the filler not degrade the physical properties of the outer layer of the fuser member, and it is also important that the filler not cause too much of an increase in the surface energy of the outer layer.

Fillers are also sometimes added to the outer layers of fuser members to increase the thermal conductivity thereof. Examples of such fillers include conductive carbon, carbon black, graphite, titanium, boron nitride, zinc oxide, aluminum oxide, and the like, as well as mixtures thereof. Efforts have been made to decrease the use of energy by providing a fuser member that has excellent thermal conductivity, thereby reducing the temperature needed to promote fusion of toner to paper. This increase in thermal conductivity also allows for increased speed of the fusing process by reducing the amount of time needed to heat the fuser member sufficiently to promote fusing. Efforts have also been made to increase the toughness of the fuser member layers to increase abrasion resistance and, accordingly, the life of the fuser member.

With regard to known fuser coatings, hydrofluoroelastomers, Teflons® and silicone rubbers are traditionally used. For these coatings, release agents are required. Silicone rubbers interact well with various types of fuser release agents. Perfluoroalkoxypolytetrafluoroethylene (PFA Teflon), however, which is frequently used as an outer coating for fuser members, is more durable and abrasion resistant than silicone rubber coatings. Also, the surface energy for PFA Teflon is lower than that of silicone rubber coatings. Fluorohydroelastomers have relatively higher surface energy, are durable, and provide adequate release capability with the functionalized polydimethylsiloxane based release fluids.

U.S. Pat. No. 3,002,927 (Awe et al.), the disclosure of which is totally incorporated herein by reference, discloses organosilicon fluids capable of withstanding high temperatures which are prepared by preoxygenating the fluid by heating a mixture of (1) a polysiloxane fluid in which the siloxane units are selected from the group consisting of units of the formula $R_3SiO_{0.5}$, $R_2SiO$, $RSiO_{1.5}$, and $SiO_2$ in which each R is selected from the group consisting of methyl, phenyl, chlorophenyl, fluorophenyl, and bromophenyl radicals, (2) a ferric salt of a carboxylic acid having from 4 to 18 carbon atoms in an amount such that there is from 0.005 to 0.03 percent by weight iron based on the weight of (1), and (3) oxygen mechanically dispersed in the fluid at a temperature above 400° F. until the mixture changes to a reddish brown color and until the mixture will not form a precipitate when heated in the absence of oxygen at a temperature above that at which the preoxygenation step is carried out.

U.S. Pat. No. 3,731,358 (Artl), the disclosure of which is totally incorporated herein by reference, discloses a silicone rubber roll for pressure fusing of electrostatically produced and toned images at elevated temperatures. The roll inherently prevents offset of the image by supplying a release material to the surface of the roll. When the release material is depleted, the roll can be restored by impregnation with silicone oil.

U.S. Pat. No. 4,011,362 (Stewart), the disclosure of which is totally incorporated herein by reference, discloses metal substrates such as molds and fuser rolls, which are coated with carboxyfunctional siloxanes to improve their release characteristics.

U.S. Pat. No. 4,029,827 (Imperial et al.), the disclosure of which is totally incorporated herein by reference, discloses polyorganosiloxanes having functional mercapto groups which are applied to a heated fuser member in an electrostatic reproducing apparatus to form thereon a thermally stable, renewable, self-cleaning layer having superior toner release properties for electroscopic thermoplastic resin toners. The polyorganosiloxane fluids having functional mercapto groups interact with the fuser member in such a manner as to form an interfacial barrier at the surface of the fuser member while leaving an unreacted, low surface energy release fluid as an outer layer or film. The interfacial barrier is strongly attached to the fuser member surface and prevents toner material from contacting the outer surface of the fuser member. The material on the surface of the fuser member is of minimal thickness and thereby represents a minimal thermal barrier. The polyorganosiloxanes having mercapto-functionality have also been effectively demonstrated as excellent release agents for the reactive types of toners having functional groups thereon.

U.S. Pat. No. 4,046,795 (Martin), the disclosure of which is totally incorporated herein by reference, discloses a process for preparing thiofunctional polysiloxane polymers which comprises reacting a disiloxane and/or a hydroxy or hydrocarbonoxy containing silane or siloxane with a cyclic trisiloxane in the presence of an acid catalyst wherein at least one of the organosilicon compounds contain a thiol group. These thiofunctional polysiloxane polymers are useful as metal protectants and as release agents, especially on metal substrates.

U.S. Pat. No. 4,101,686 (Strella et al.), the disclosure of which is totally incorporated herein by reference, discloses polymeric release agents having functional groups such as carboxy, hydroxy, epoxy, amino, isocyanate, thioether, or mercapto groups. The release agents are applied to a heated fuser member in an electrostatic reproducing apparatus to form thereon a thermally stable, renewable, self-cleaning layer having excellent toner release properties for conventional electroscopic thermoplastic resin toners. The functional polymeric fluids interact with the fuser member in such a manner as to form a thin, thermally stable interfacial barrier at the surface of the fuser member while leaving an outer film or layer of unreacted release fluid. The interfacial barrier is strongly attached to the fuser member surface and prevents electroscopic thermoplastic resin toner material from contacting the outer surface of the fuser member. The material on the surface of the fuser member is of minimal thickness and thereby represents a minimal thermal barrier.

U.S. Pat. No. 4,146,659 (Swift et al.), the disclosure of which is totally incorporated herein by reference, discloses fuser members having surfaces of gold and the platinum group metals and alloys thereof for fuser assemblies in office copier machines. Preferred fuser assemblies include cylindrical rolls having at least an outer surface of gold, a platinum group metal, or alloys thereof. Electroscopic thermoplastic resin toner images are fused to a substrate by using a bare gold, a platinum group metal, or alloys thereof fuser member coated with polymeric release agents having reactive functional groups, such as a mercapto-functional polysiloxane release fluid.

U.S. Pat. No. 4,150,181 (Smith), the disclosure of which is totally incorporated herein by reference, discloses a contact fuser assembly and method for preventing toner offset on a heated fuser member in an electrostatic reproducing apparatus which includes a base member coated with a solid, abrasion resistant material such as polyimide, poly(amide-imides), poly(imide-esters), polysulfones, and aromatic polyamides. The fuser member is coated with a thin layer of polysiloxane fluid containing low molecular weight fluorocarbon. Toner offset on the heated fuser member is prevented by applying the polysiloxane fluid containing fluorocarbon to the solid, abrasion resistant surface of the fuser member.

U.S. Pat. No. 4,185,140 (Strella et al.), the disclosure of which is totally incorporated herein by reference, discloses polymeric release agents having functional groups such as carboxy, hydroxy, epoxy, amino, isocyanate, thioether, or mercapto groups which are applied to a heated fuser member in an electrostatic reproducing apparatus to form thereon a thermally stable, renewable, self-cleaning layer having excellent toner release properties for conventional electroscopic thermoplastic resin toners. The functional polymeric fluids interact with the fuser member in such a manner as to form a thin, thermally stable interfacial barrier at the surface of the fuser member while leaving an outer film or layer of unreacted release fluid. The interfacial barrier is strongly attached to the fuser member surface and prevents electroscopic thermoplastic resin toner material from contacting the outer surface of the fuser member. The material on the surface of the fuser member is of minimal thickness and thereby represents a minimal thermal barrier.

U.S. Pat. No. 4,515,884 (Field et al.), the disclosure of which is totally incorporated herein by reference, discloses the fusing of toner images to a substrate, such as paper, with a heated fusing member having a silicone elastomer fusing surface by coating the elastomer fusing surface with a toner release agent which includes an unblended polydimethyl siloxane having a kinematic viscosity of from about 7,000 to about 20,000 centistokes. In a preferred embodiment the polydimethyl siloxane oil has a kinematic viscosity of from about 10,000 to about 16,000 centistokes and the fuser member is a fuser roll having a thin layer of a crosslinked product of a mixture of α,ω-dihydroxypolydimethyl siloxane, finely divided tabular alumina, and finely divided iron oxide.

U.S. Pat. No. 5,157,445 (Shoji et al.), the disclosure of which is totally incorporated herein by reference, discloses a fixing device where a copying medium carrying a nonfixed toner image thereon is passed between a pair of fixing rolls as being kept in direct contact with each other under pressure so as to fix the nonfixed toner image on the copying medium, the device being characterized in that a toner release at least containing, as an active ingredient, an amino-functional-group-containing organopolysiloxane of the general formula

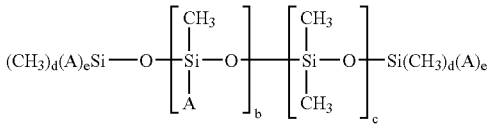

the organopolysiloxane having a viscosity of from 10 to 100,000 cs at 25° C., is supplied to at least the fixing roll of being brought into contact with the nonfixed toner image of the pair of fixing rolls.

U.S. Pat. No. 5,395,725 (Bluett et al.), the disclosure of which is totally incorporated herein by reference, discloses a process for fusing toner images to a substrate which comprises providing a fusing member having a fusing surface; heating the fuser member to an elevated temperature to fuse toner to the substrate; and applying directly to the fusing surface a fuser release agent oil blend composition; wherein volatile emissions arising from the fuser release agent oil blend are minimized or eliminated. The fuser release agent oil comprises the addition of small amounts of mercapto-functional polyorganosiloxanes to other functional fluids, including amino-functional polyorganosiloxanes, in order to enhance stabilization against degradation leading to volatile emissions.

U.S. Pat. No. 5,401,570 (Heeks et al.), the disclosure of which is totally incorporated herein by reference, discloses a fuser member comprising a substrate and thereover a silicone rubber containing a filler component therein, wherein the filler component is reacted with a silicone hydride release oil.

U.S. Pat. No. 5,493,376 (Heeks), the disclosure of which is totally incorporated herein by reference, discloses a thermally stabilized polyorganosiloxane oil including a polyorganosiloxane oil and, as the thermal stabilizer, the reaction product of chloroplatinic acid and a member selected from the group consisting of a cyclic polyorganosiloxane having the formula

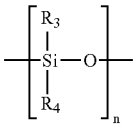

where $R_3$ is an alkyl radical having 1 to 6 carbon atoms and $R_4$ is selected from the group consisting of alkene and alkyne radicals having 2 to 8 carbon atoms, and n is from 3 to 6; a linear polyorganosiloxane having the formula

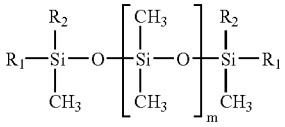

wherein $R_1$ and $R_2$ are selected from the group consisting of hydroxy and alkyl, alkoxy, alkene, and alkyne radicals having 1 to 10 carbon atoms, provided that at least one of $R_1$ and $R_2$ is alkene or alkyne, and m is from 0 to 50; and mixtures thereof, present in an amount to provide at least 5 parts per million of platinum in said oil.

U.S. Pat. No. 5,512,409 (Henry et al.), the disclosure of which is totally incorporated herein by reference, discloses a method of fusing thermoplastic resin toner images to a substrate in a fuser including a heated thermally stable FKM hydrofluoroelastomer fusing surface at elevated temperature prepared in the absence of anchoring sites for a release agent of heavy metals, heavy metal oxides, or other heavy metal compounds forming a film of a fluid release agent on the elastomer surface of an amino-functional oil having the formula U.S. Pat. No. 5,516,361 (Chow et al.), the disclosure of which is totally incorporated herein by reference, discloses a fusing system, a method of fusing, and a fuser member having a thermally stable FKM hydrofluoroelastomer surface for fusing thermoplastic resin toners to a substrate in an electrostatographic printing apparatus, said fuser member having a polyorgano T-type amino-functional oil release agent. The oil has predominantly monoamino-functionality per active molecule to interact with the hydrofluoroelastomer surface to provide a substantially uniform interfacial barrier layer to the toner and a low surface energy film to release the toner from the surface.

U.S. Pat. No. 5,531,813 (Henry et al.), the disclosure of which is totally incorporated herein by reference, discloses a polyorgano amino-functional oil release agent having at least 85 percent monoamino-functionality per active molecule to interact with the thermally stable FKM hydrofluoroelastomer surface of a fuser member of an electrostatographic apparatus to provide an interfacial barrier layer to the toner and a low surface energy film to release the toner from the surface.

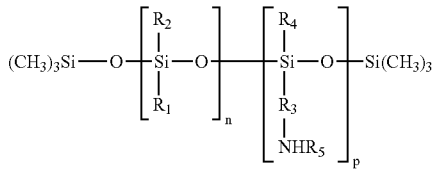

where 50<n<200, p is 1 to 5, $R_{R2}$, and $R_3$ are alkyl or arylalkyl radicals having 1 to 18 carbon atoms, $R_4$ is an alkyl or arylalkyl radical having 1 to 18 carbon atoms and a polyorganosiloxane chain having 1 to 100 diorganosiloxy repeat units, and $R_5$ is a hydrogen, alkyl, or arylalkyl radical having 1 to 18 carbon atoms, the oil having sufficient amino-functionality per active molecule to interact with the hydrofluoroelastomer surface in the absence of a heavy metal and heavy metal anchoring sites to provide an interfacial barrier layer to the toner and a low surface energy film to release the toner from the surface. The process entails contacting the toner image on the substrate with the filmed heated elastomer surface to fuse the toner image to the substrate and permitting the toner to cool.

U.S. Pat. No. 5,747,212 (Kaplan et al.), the disclosure of which is totally incorporated herein by reference, discloses a method of fusing and a fusing system for a fusing member having a thermally stable FKM hydrofluoroelastomer surface for fusing thermoplastic resin toners which are susceptible to amines to a substrate in an electrostatographic printing apparatus with an amino-functional oil having the formula:

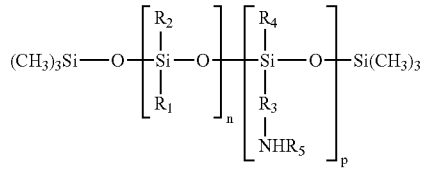

where 50<n<200, p is 1 to 5, and $R_1$, $R_2$, and $R_3$ are selected from the group consisting of alkyl and arylalkyl radicals having 1 to 18 carbon atoms, $R_4$ is selected from the group consisting of alkyl and arylalkyl radicals having 1 to 18 carbon atoms and a polyorganosiloxane chain having 1 to 100 diorganosiloxy repeat units, and $R_5$ is selected from the group consisting of hydrogen, alkyl and arylalkyl radicals having 1 to 18 carbon atoms, wherein at least 85 percent of the polyorgano amino-functional siloxane chains have p equal to 1 and the

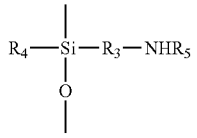

groups are situated at random along the chain, said oil having predominantly monoamino-functionality per active molecule to interact with said hydrofluoroelastomer surface to provide an interfacial barrier layer to said toner and a low surface energy film to release said toner from said surface.

U.S. Pat. No. 5,864,740 (Heeks et al.), the disclosure of which is totally incorporated herein by reference, discloses a thermally stabilized silicone liquid composition and a toner fusing system using the thermally stabilized silicone liquid as a release agent, wherein the thermally stabilized silicone liquid contains a silicone liquid and a thermal stabilizer composition (including a reaction product from at least a polyorganosiloxane and a platinum metal compound (Group VIII compound) such as a ruthenium compound, excluding platinum.

U.S. Pat. No. 6,183,929 (Chow et al.), the disclosure of which is totally incorporated herein by reference, relates to a release agent comprising a mixture of a non-functional organosiloxane polymer with a functional organosiloxane polymer such as an amino-substituted or mercapto-substituted organosiloxane.

U.S. Pat. No. 6,253,055 (Badesha et al.), the disclosure of which is totally incorporated herein by reference, discloses fuser members coated with hydride release oils, and materials and imaging apparatus thereof.

U.S. Pat. No. 6,261,688 (Kaplan et al.), the disclosure of which is totally incorporated herein by reference, discloses tertiary amino-functionalized fuser fluids. The fuser fluids comprise polyorganosiloxanes having tertiary amino-functional groups on at least some of the molecules thereof.

With regard to known fusing oils, silicone oil has been the preferred release agent for coatings for fuser members. However, as noted above, many difficulties exist with the use of different types of silicone oils. As a result, while there are many different types of silicone oils, with a wide range of properties that vary according to the type of functional agent, molecular weight, viscosities, etc., a great deal of research continues in order to develop improved fusing oils or mixtures thereof.

Mercapto-functional polyorganosiloxane release fluids have frequently been utilized with the outer layers of fluoropolymer fuser members. These outer layers, or overcoats, of the fluoropolymer fuser members (or rolls) generally contain a metal oxide filler such as copper oxide or aluminum oxide. An example of such a fluoropolymer fuser roll is a copper oxide filled VITON® overcoat fuser roll. The mercapto groups present in the mercapto-functional polyorganosiloxanes bind to the copper oxide (CuO) sites to provide a fluid layer that protects the fuser member from toner contact. Such a combination has been successful (i.e., exhibits long release life) for producing black and white copies (black toner) utilizing styrene-butadiene based toner resins.

However, a much shorter release life has been observed when the mercapto-functional polyorganosiloxanes are utilized in the production of color prints. This is believed to be due to a number of factors, including the use of more highly reactive polyester toner resins, high levels of toner additives, higher toner pile heights, wider use of halftones and a larger area of coverage. Consequently, it would be beneficial to produce a fuser fluid, fuser oil or release agent that exhibits longer release life for use in printers capable of black and/or color printing, including classical black and white (I), full-color color image on image (IOI) and highlight color image next to image (INI) applications.

In this regard, amino-functional polyorganosiloxanes have been utilized for color printing. The amino groups do not require copper oxide anchor sites, as do the mercapto groups, because the amino groups can directly react with the fuser roll VITON® overcoat polymer itself. Accordingly, copper oxide filled VITON® overcoat fuser rolls are not necessary for color printing utilizing amino-functional polyorganosiloxanes.

Moreover, it has also been observed that because the amino groups in the amino-functional polyorganosiloxanes bind more firmly to the fuser roll surface than the mercapto groups, more robust protection can be achieved using the amino-functional polyorganosiloxanes than the mercapto-functional polyorganosiloxanes. The consequence of this mechanism is significantly longer fuser release life with amino-functional polyorganosiloxanes versus mercapto-functional polyorganosiloxanes.

However, when utilized for black and white printing (black toner), it has been found that high mole % amino-functional polyorganosiloxanes contaminate the paper path rolls, reducing their friction and causing slippage. This occurs due to the chemical interacting of the amino-functionality of the oil with the components of the paper. Additionally, the highly reactive amino groups sometime produce fuser roll contamination. Moreover, the amino-functional groups also produce side effects, which include post-processing difficulty with the writing, or typing, on the prints, difficulty with laminating, and poorer reliability due to the amino oil effect on the paper handling system.

Furthermore, it has also been noted that when mercapto-functional polyorganosiloxanes are utilized for black and white printing (black toner), additional fuser performance issues have occurred, depending upon toner composition. These include paper jams, shortened release life and image quality problems with high area coverage. Hence, it would be desirable to develop a fuser fluid, oil and/or release agent that can be utilized for black, highlighted color and full color utilizing IOI or INI, which overcomes the deficiencies noted above.

Moreover, a need remains for fuser release agents that do not interact chemically with copy substrates such as paper. Further, a need remains for fuser release agents that enable the production of prints upon which adhesives such as those on 3M Post-It® notes adhere adequately.

Additionally, a need remains for fuser release agents that enable the use of pre-printed forms. There is also a need for fuser release agents that enable the production of prints which can then be bound well with binder adhesives. In addition, there is a need for fuser release agents that react well with fluoropolymers and fluoroelastomers commonly used as fuser member outer layers. Further, there is a need for fuser release agents that form complete and uniform layers on fuser members having fluoropolymer surfaces. Moreover, there is a need for fuser release agents that enable long release life times for fuser members employed therewith. A need also remains for fuser release agents that protect the underlying fuser member materials from reactive toner materials, such as highly reactive polyester toner resins. In addition, a need remains for fuser release agents that prevent or reduce offset of paper and toner additives onto the fuser member.

SUMMARY

In one aspect, the present disclosure relates to a fuser fluid, fuser oil or release agent including mercapto- and amino-functionalities comprising from about 0.05 mole percent to about 1.00 mole percent mercapto groups and from about 0.0001 mole percent to about 0.06 mole percent amino groups. The ratio of mercapto to amino mole percent values is at least 2. The mole percent values represent the amount of functional groups present in the fluid of this disclosure relative to the total number of organosiloxane repeat units present in the polymer. It has been found that this composition exhibits improved fuser (hard or soft) release life, reduced image offset onto the fuser roll, and improved quality for high coverage prints. Moreover, the composition produces enhanced release life when utilized with highly reactive, color polyester toner resins and fluoropolymer or fluoroelastomer filled (i.e. CuO, $Al_2O_3$, $Al_3O_4$, etc.) fuser overcoats such as those found in highlighted color duplicating machines (INI).

In a further aspect, the development disclosed herein is directed to a fuser member comprising a substrate, a layer thereover comprising a fluoropolymer or fluoroelastomer, and on the layer a coating of a release agent comprising from about 0.10 mole percent to about 0.20 mole percent of a mercapto group and from about 0.003 to about 0.03 mole percent of amino groups. The ratio of mercapto to amino mole percent values is at least 5. Again, the mole percent values represent the amount of functional groups present in the fluid of this invention relative to the total number of organosiloxane repeat units present in the polymer. When utilized with reactive toner materials, such as highly reactive polyester toner resins, the coating of the release agent is effective in protecting the underlying fuser member materials.

In another aspect, the present disclosure relates to a fuser fluid, fuser oil or release agent comprising from about 0.15 mole percent to about 0.20 mole percent mercapto groups and 0.003 mole percent to about 0.012 mole percent amino groups. The ratio of mercapto to amino mole percent values is at least 10. As mentioned, the mole percent values represent the amount of functional groups present in the fluid of this disclosure relative to the total number of organosiloxane repeat units present in the polymer. This composition produces a fuser fluid that demonstrates a much improved release life.

In a still further aspect, the present development is directed to a fuser member comprising a substrate, a layer thereover comprising a polymer or elastomer, and, on the layer, a coating of a release agent comprising mercapto- and amino-functional polyorganosiloxanes. Preferably, the coating comprises a mercapto-substituted organosiloxane polymer with a minor or lesser amount of an amino-substituted organosiloxane polymer. Such release agents produce in various embodiments enhanced results, i.e., decreased paper jams, improved fuser release life, and improved quality.

In still another aspect, the disclosure concerns an image forming apparatus for forming images on a recording medium comprising: a) a charge-retentive surface to receive an electrostatic latent image thereof; b) a development component to apply toner to the charge-retentive surface to develop the electrostatic latent image to form a developed image on the charge retentive surface; c) a transfer component to transfer the developed image from the charge retentive surface to a copy substrate; and d) a fixing component for fusing toner images to a surface of the copy substrate, wherein the fixing component comprises a fuser member (hard or soft) comprising: i) a substrate; ii) an outer layer provided on the substrate, the outer layer comprising a polymer or elastomer; and iii) film over the outer surface of the outer polymer or elastomer layer, the release film comprising the mercapto and amino mole percentages set forth above.

In still yet another aspect, the present disclosure relates to an electrophotographic process comprising: a) forming an electrostatic latent image on charge-retentive surface; b) applying toner to the latent image to form a developed image on the charge-retentive surface; c) transferring the toner image from the charge-retentive surface to a copy substrate; d) fixing the toner image to the copy substrate by passing the copy substrate containing the toner image in between a pressure member and a fixing member, wherein the pressure member and the fixing member are-in pressure contact, and the fixing member comprises: i) a substrate; ii) an outer layer provided on said substrate, and outer layer comprising a filled (CuO, $Al_2O_3$, etc.) fluoropolymer or fluoroelastomer; and iii) a release film over said outer surface of said outer layer, said release film comprising the mercapto and amino mole percentages set forth above.

Moreover, the disclosure relates to toners and full process color processes, wherein full color refers for example to IOI printing of but not limited to cyan, magenta, yellow and black toners, and toner refers for example to a mixture comprised of resin, colorant, toner additives such as waxes, charge additives, and surface additives, for example U.S. Pat Nos. 6,242,145 and 6,326,119, the disclosures of which are totally incorporated herein by reference. In another embodiment, the disclosure relates to toners and highlight color processes, wherein highlight color refers for example to INI printing of but not limited to cyan, magenta, yellow, blue, green, red, orange, violet or brown toner, or mixtures thereof, next to black toner. One toner composition suitable for embodiments of the present invention is comprised of a partially gelled propoxylated bisphenol-A fumarate resin; Lithol Scarlet Pigment; silica, titania and calcium stearate additives; and a PMMA coated steel grit carrier.

These and other aspects and/or objects of the development are more particularly disclosed below.

BRIEF DESCRIPTION OF THE DRAWINGS

The following is a brief description of the drawings, which are presented for the purposes of illustrating the development disclosed herein and not for the purposes of limiting the same.

FIGS. 4-7 are a series of photomicrographs of fuser rolls coated with various silicone oils.

DETAILED DESCRIPTION

The present application is directed to improved fuser fluids, fuser oils or release agents comprising mercapto- and amino-functionalities. In this regard, the fuser fluids, fuser oils or release agents of the present disclosure comprise from about 0.05 to about 1.00 mole percent of mercapto groups and from about 0.0001 to about 0.060 mole percent of amino groups. The ratio of mercapto to amino mole percent value is at least 2. The mole percent values represent the amount of functional groups present in the fluid of this disclosure relative to the total number of organosiloxane repeat units present in the polymer. Among other characteristics, the improved fuser fluids, fuser oils or release agents of the present disclosure exhibit enhanced release and fuser life and improved paper interactions.

Preferably, the fuser fluids, fuser oils or release agents of the present development comprise from about 0.10 to about 0.20 mole percent of mercapto groups, and from about 0.003 to about 0.030 mole percent of amino groups. The ratio of mercapto to amino mole percent value is at least 5.

More preferably, the fuser fluids, fuser oils or release agents disclosed herein comprise from about 0.15 to about 0.20 mole percent of mercapto groups, and from about 0.003 to about 0.012 mole percent of amino groups. The ratio of mercapto to amino mole percent value is at least 10.

Furthermore, the present development is also directed to a fuser member comprising a substrate, a polymeric layer thereupon comprising preferably a filled (carbon black, boron nitride CuO, $Al_2O_3$, zinc oxide, etc.) fluoropolymer or fluoroelastomer and, on the polymeric layer, a coating of a release agent comprising specific blends of mercapto-functional polyorganosiloxanes with, preferably, lesser or minor amounts of amino-functional polyorganosiloxanes. The present development also relates to the use of the improved fuser fluids, fuser oils or release agents for enhancing the release of toner particles, particularly highly reactive polyester toner particles, from a fuser roll (hard or soft) in an electrostatic, especially xerographic, reproducing apparatus.

Figure 1:
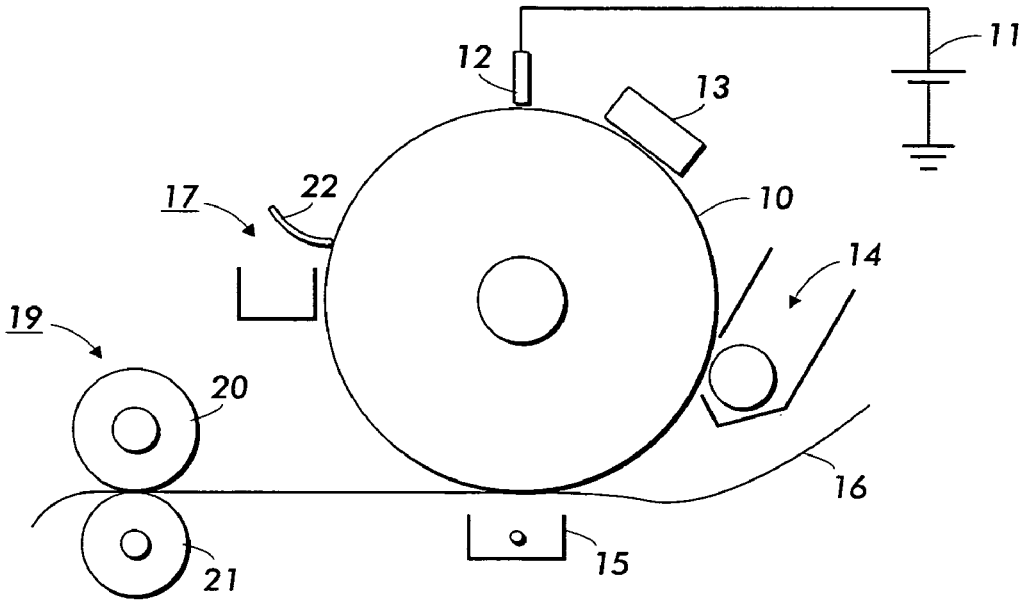
FIG. 1 is an illustration of a general electrostatographic apparatus.

Referring now to the Figures, wherein like reference numerals are used to denote like or analogous components throughout several views, FIG. 1 represents a typical electrostatographic reproducing apparatus, wherein a light image of an original to be copied is recorded in the form of an electrostatic latent image on a photosensitive member, and the latent image is subsequently rendered visible by the application of electroscopic thermoplastic resin particles, commonly referred to as toner. Specifically, photoreceptor 10 is charged on its surface by means of a charger 12 to which a voltage has been supplied from power supply 11. The photoreceptor is then imagewise exposed to light from an optical system or an image input apparatus 13, such as a laser and/or light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process.

After the toner particles have been deposited on the photoconductive surface in image configuration, they are transferred to a copy sheet 16 by transfer means 15, which can be pressure transfer, electrostatic transfer, or the like. Alternatively, the developed image can be transferred to an intermediate transfer member and subsequently transferred to a copy sheet.

After transfer of the developed image is completed, copy sheet 16 advances to fusing station 19, depicted in FIG. 1 as fusing and pressure rolls, wherein the developed image is fused to copy sheet 16 by passing copy sheet 16 between fusing member 20 and pressure member 21, thereby forming a permanent image. Photoreceptor 10, subsequent to transfer, advances to cleaning station 17, wherein any toner left on photoreceptor 10 is cleaned therefrom by use of a blade 22 (as shown in FIG. 1), brush, or other cleaning apparatus.

Figure 2:
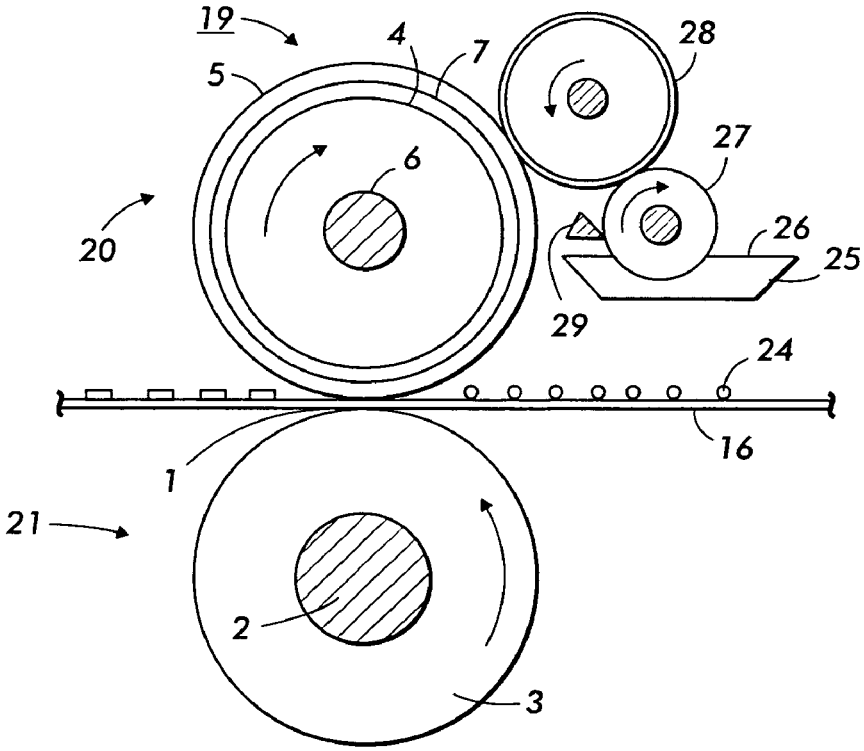
FIG. 2 illustrates a fusing system in accordance with an embodiment of the present development.

Referring to FIG. 2, for illustration purposes only, an embodiment of a fusing station 19 is depicted with an embodiment of a fuser roll 20 comprising polymer or elastomer surface 5 on a suitable base member or substrate 4, which in this embodiment is a hollow cylinder or core fabricated from any suitable metal, such as aluminum, anodized aluminum, steel, nickel, copper, or the like, having a suitable heating element 6 disposed in the hollow portion thereof which is coextensive with the cylinder. The fuser member 20 optionally can include an adhesive, cushion, or other suitable layer 7 positioned between core 4 and outer layer 5. Backup or pressure roll 21 cooperates with fuser roll 20 to form a "nip" or contact arc 1 through which a copy paper or other substrate 16 passes such that toner images 24 thereon contact polymer or elastomer surface 5 of fuser roll 20. As shown in FIG. 2, an embodiment of a backup roll or pressure roll 21 is depicted as having a rigid steel core 2 with a polymer or elastomer surface or layer 3 thereon. Sump 25 contains polymeric release agent 26, which may be a solid or liquid at room temperature, but is a fluid at operating temperatures, and in fuser members of the present invention, an organosiloxane polymer comprising mercapto- and amino-functionalities. The pressure member 21 can also optionally include a heating element (not shown).

In the embodiment shown in FIG. 2 for applying the polymeric release agent 26 to polymer or elastomer surface 5, two release agent delivery rolls 27 and 28 rotatably mounted in the direction indicated are provided to transport release agent 26 to polymer or elastomer surface 5. Delivery roll 27 is partly immersed in the sump 25 and transports on its surface release agent from the sump to the delivery roll 28. By using a metering blade 29, a layer of polymeric release fluid can be applied initially to delivery roll 27 and subsequently to polymer or elastomer 5 in controlled thickness ranging from submicron thickness to thicknesses of several microns of release fluid. Thus, by metering device 29, preferably from about 0.1 to about 2 microns or greater thicknesses of release fluid can be applied to the surface of polymer or elastomer 5.

Figure 3:
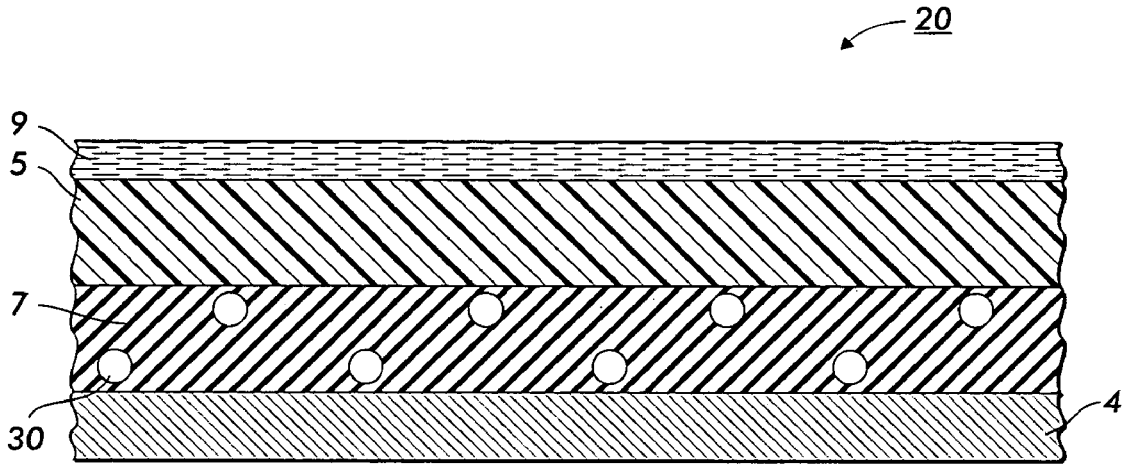
FIG. 3 demonstrates a cross-sectional view of an embodiment of the present development.

FIG. 3 depicts a cross-sectional view of another embodiment of the invention, wherein fuser member 20 comprises substrate 4, optional intermediate surface layer 7 comprising silicone rubber and optional fillers 30, such as copper or aluminum oxide or the like, dispersed or contained therein, and outer polymer or elastomer surface layer 5. FIG. 3 also depicts a blend of mercapto-functional and amino-functional polyorganosiloxanes as the fluid release agent or fusing oil layer 9.

The term "fuser member" as used herein refers to fuser members including fusing rolls, belts, films, sheets, and the like; donor members, including donor rolls, belts, films, sheets, and the like; and pressure members, including pressure rolls, belts, films, sheets, and the like; and other members useful in the fusing system of an electrostatographic or xerographic, including digital, machine. The fuser member of the present invention can be employed in a wide variety of machines, and is not specifically limited in its application to the particular embodiment depicted herein.

Any suitable substrate can be selected for the fuser member. The fuser member substrate can be a roll, belt, flat surface, sheet, film, or other suitable shape used in the fixing of thermoplastic toner images to a suitable copy substrate. It can take the form of a fuser member, a pressure member, or a release agent donor member, preferably in the form of a cylindrical roll. Typically, the fuser member is made of a hollow cylindrical metal core, such as copper, aluminum, stainless steel, or certain plastic materials chosen to maintain rigidity and structural integrity, as well as being capable of having a polymeric material coated thereon and adhered firmly thereto. It is preferred that the supporting substrate is a cylindrical sleeve, preferably with an outer polymeric layer of from about 1 to about 6 millimeters. In one embodiment, the core, which can be an aluminum or steel cylinder, is degreased with a solvent and cleaned with an abrasive cleaner prior to being primed with a primer, such as Dow Corning® 1200, which can be sprayed, brushed, or dipped, followed by air drying under ambient conditions for thirty minutes and then baked at 150° C. for 30 minutes.

Also suitable are quartz and glass substrates. The use of quartz or glass cores in fuser members allows for a lightweight, low cost fuser system member to be produced. Moreover, the glass and quartz help allow for quick warm-up, and are therefore energy efficient. In addition, because the core of the fuser member comprises glass or quartz, there is a real possibility that such fuser members can be recycled. Moreover, these cores allow for high thermal efficiency by providing superior insulation.

When the fuser member is a belt, the substrate can be of any desired or suitable material, including plastics, such as Ultem®, available from General Electric, Ultrapek®, available from BASF, PPS (polyphenylene sulfide) sold under the tradenames Fortron®, available from Hoechst Celanese, Ryton R-4®, available from Phillips Petroleum, and Supec®, available from General Electric; PAI (polyamide imide), sold under the tradename Torlon® 7130, available from Amoco; polyketone (PK), sold under the tradename Kadel® E1230, available from Amoco; PI (polyimide); polyaramide; PEEK (polyether ether ketone), sold under the tradename PEEK 450GL30, available from Victrex; polyphthalamide sold under the tradename Amodel®, available from Amoco; PES (polyethersulfone); PEI (polyetherimide); PAEK (polyaryletherketone); PBA (polyparabanic acid); silicone resin; and fluorinated resin, such as PTFE (polytetrafluoroethylene); PFA (perfluoroalkoxy); FEP (fluorinated ethylene propylene); liquid crystalline resin (Xydar®), available from Amoco; and the like, as well as mixtures thereof. These plastics can be filled with glass or other minerals to enhance their mechanical strength without changing their thermal properties. In preferred embodiments, the plastic comprises a high temperature plastic with superior mechanical strength, such as polyphenylene sulfide, polyamide imide, polyimide, polyketone, polyphthalamide, polyether ether ketone, polyethersulfone, and polyetherimide. Suitable materials also include silicone rubbers. Examples of belt-configuration fuser members are disclosed in, for example, U.S. Pat. Nos. 5,487,707, 5,514,436, and application U.S. Ser. No. 08/297,203, filed Aug. 29, 1994, the disclosures of each of which are totally incorporated herein by reference. A method for manufacturing reinforced seamless belts is disclosed in, for example, U.S. Pat. No. 5,409,557, the disclosure of which is totally incorporated herein by reference.

The optional intermediate layer can be of any suitable or desired material. For example, the optional intermediate layer can comprise a silicone rubber of a thickness sufficient to form a conformable layer. Suitable silicone rubbers include room temperature vulcanization (RTV) silicone rubbers, high temperature vulcanization (HTV) silicone rubbers, and low temperature vulcanization (LTV) silicone rubbers. These rubbers are known and are readily available commercially such as SILASTIC® 735 black RTV and SILASTIC® 732 RTV, both available from Dow Corning, and 106 RTV Silicone Rubber and 90 RTV Silicone Rubber, both available from General Electric. Other suitable silicone materials include the silanes, siloxanes (preferably polydimethylsiloxanes), such as fluorosilicones, dimethylsilicones, liquid silicone rubbers, such as vinyl crosslinked heat curable rubbers or silanol room temperature crosslinked materials, and the like. Other materials suitable for the intermediate layer include polyimides and fluoroelastomers, including those set forth below.

Silicone rubber materials can swell during the fusing process, especially in the presence of a release agent. In the case of fusing color toner, normally a relatively larger amount of release agent is necessary to enhance release because of the need for a larger amount of color toner than is required for black and white copies and prints. Accordingly, the silicone rubber is more susceptible to swell in an apparatus using color toner. Aluminum oxide added in a relatively small amount can reduce the swell and increase the transmissibility of heat. This increase in heat transmissibility is preferred in fusing members useful in fusing color toners, since a higher temperature (for example, from about 155 to about 180° C.) is usually needed to fuse color toner, compared to the temperature required for fusing black and white toner (for example, from about 50 to about 180° C.).

Accordingly, optionally dispersed or contained in the intermediate silicone rubber layer is aluminum oxide in a relatively low amount of from about 0.05 to about 5 percent by volume, preferably from about 0.1 to about 5 percent by volume, and more preferably from about 2.2 to about 2.5 percent by total volume of the intermediate layer. In addition to the aluminum oxide, other metal oxides and/or metal hydroxides can be used. Such metal oxides and/or metal hydroxides include tin oxide, zinc oxide, calcium hydroxide, magnesium oxide, lead oxide, chromium oxide, copper oxide, and the like, as well as mixtures thereof. In a preferred embodiment, a metal oxide is present in an amount of from about 10 to about 50 percent by volume, preferably from about 20 to about 40 percent by volume, and more preferably from about 30 to about 35 percent by total volume of the intermediate layer. In a preferred embodiment copper oxide is used in these amounts in addition to the aluminum oxide. In a particularly preferred embodiment, copper oxide is present in an amount of from about 30 to about 35 percent by volume and aluminum oxide is present in an amount of from about 2.2 to about 2.5 percent by total volume of the intermediate layer. In preferred embodiments, the average particle diameter of the metal oxides such as aluminum oxide or copper oxide preferably is from about 1 to about 10 microns, and more preferably from about 3 to about 5 microns, although the average particle diameter can be outside of these ranges.

The optional intermediate layer typically has a thickness of from about 0.05 to about 10 millimeters, preferably from about 0.1 to about 5 millimeters, and more preferably from about 1 to about 3 millimeters, although the thickness can be outside of these ranges. More specifically, if the intermediate layer is present on a pressure member, it typically has a thickness of from about 0.05 to about 5 millimeters, preferably from about 0.1 to about 3 millimeters, and more preferably from about 0.5 to about 1 millimeter, although the thickness can be outside of these ranges. When present on a fuser member, the intermediate layer typically has a thickness of from about 1 to about 10 millimeters, preferably from about 2 to about 5 millimeters, and more preferably from about 2.5 to about 3 millimeters, although the thickness can be outside of these ranges. In a preferred embodiment, the thickness of the intermediate layer of the fuser member is higher than that of the pressure member, so that the fuser member is more deformable than the pressure member.

Examples of suitable outer fusing layers of the fuser member include polymers, such as fluoropolymers. Particularly useful fluoropolymer coatings for the present invention include TEFLON®-like materials such as polytetrafluoroethylene (PTFE), fluorinated ethylenepropylene copolymer (FEP), perfluorovinylalkylether tetrafluoroethylene copolymer (PFA TEFLON®), polyethersulfone, copolymers and terpolymers thereof, and the like. Also suitable are elastomers such as fluoroelastomers. Specifically, suitable fluoroelastomers are those described in, for example, U.S. Pat. Nos. 5,166,031, 5,281,506, 5,366,772, 5,370,931, 4,257,699, 5,017,432, and 5,061,965, the disclosures of each of which are totally incorporated herein by reference. These fluoroelastomers, particularly from the class of copolymers, terpolymers, and tetrapolymers of vinylidene fluoride, hexafluoropropylene, and tetrafluoroethylene and a possible cure site monomer, are known commercially under various designations as VITON A®, VITON E®, VITON E60C®, VITON E430®, VITON 910®, VITON GH®, VITON GF®, VITON E45®, VITON A201C®, and VITON B50®. The VITON® designation is a Trademark of E. I. Du Pont de Nemours, Inc. Other commercially available materials include FLUOREL 2170®, FLUOREL 2174®, FLUOREL 2176®, FLUOREL 2177®, FLUOREL 2123®, and FLUOREL LVS 76®, FLUOREL® being a Trademark of 3M Company. Additional commercially available materials include AFLASTM, a poly(propylene-tetrafluoroethylene), and FLUOREL II® (LII900), a poly(propylene-tetrafluoroethylenevinylidenefluoride) elastomer, both also available from 3M Company, as well as the TECNOFLONS® identified as FOR-60KIR®, FOR-LHF®, NM®, FOR-THF®, FOR-TFS®, TH®, and TN505®, available from Montedison Specialty Chemical Company. Fluoropolymer, and especially fluoroelastomer, materials such as the VITON® materials, are beneficial when used as fuser roll coatings at normal fusing temperatures (e.g., from about 50 to about 150° C.). These materials have the superior properties of high temperature stability, thermal conduction, wear resistance, and release oil swell resistance.

TEFLON®-like materials such as polytetrafluoroethylene (PTFE), fluorinated ethylenepropylene copolymers (FEP), and perfluorovinylalkylether tetrafluoroethylene copolymers (PFA TEFLON®), such as polyfluoroalkoxypolytetrafluoroethylene, are often preferred because of their increased strength and lower susceptibility to stripper finger penetration. Further, these preferred polymers, in embodiments, can provide the ability to control microporosity, which further provides oil/film control. Other preferred outer surface layers include polymers containing ethylene propylene diene monomer (EPDM), such as those EPDM materials sold under the tradename NORDEL®, available from E. I. Du Pont de Nemours & Co., an example of which is NORDEL® 1440, and POLYSAR® EPDM 345, available from Polysar. In addition, preferred outer surface layers include butadiene rubbers (BR), such as BUDENE® 1207, available from Goodyear, butyl or halobutyl rubbers, such as, EXXON Butyl 365, POLYSAR Butyl 402, EXXON Chlorobutyl 1068, and POLYSAR Bromobutyl 2030. Polymers such as FKM materials (e.g., fluoroelastomers and silicone elastomers) are preferred for use in high temperature applications, and EPDM, BR, butyl, and halobutyl materials are preferred for use in low temperature applications, such as transfix and ink applications, and for use with belts.

In another embodiment, the polymer is a fluoroelastomer having a relatively low quantity of vinylidene fluoride, such as in VITON GF®, available from E.I. Du Pont de Nemours, Inc. The VITON GF® has 35 percent by weight of vinylidene fluoride, 34 percent by weight of hexafluoropropylene, and 29 percent by weight of tetrafluoroethylene, with 2 percent by weight cure site monomer. The cure site monomer can be those available from Du Pont, such as 4-bromoperfluorobutene-1,1,1-dihydro-4-bromoperfluorobutene-1,3-bromoperfluoropropene-1,1,1-dihydro-3-bromoperfluoropropene-1, or any other suitable cure site monomer. The fluorine content of the VITON GF® is about 70 percent by weight by total weight of fluoroelastomer.

In yet another embodiment, the polymer is a fluoroelastomer having relatively low fluorine content such as VITON A201C, which is a copolymer of vinylidene fluoride and hexafluoropropylene, having about 65 percent by weight fluorine content. This copolymer is compounded with crosslinkers and phosphonium compounds used as accelerators.

Particularly preferred for the present disclosure are the fluoroelastomers containing vinylidene fluoride, such as the VITON® materials. Most preferred are the vinylidene fluoride terpolymers such as VITON® GF.

It is preferred that the fluoroelastomer have a relatively high fluorine content of from about 65 to about 71 percent by weight, preferably from about 69 to about 70 percent by weight, and more preferably from about 70 percent fluorine by weight of total fluoroelastomer. Less expensive elastomers, such as some containing about 65 percent by weight fluorine, can also be used.

Other suitable fluoropolymers include those such as fluoroelastomer composite materials, which are hybrid polymers comprising at least two distinguishing polymer systems, blocks, or monomer segments, one monomer segment (hereinafter referred to as a "first monomer segment") that possesses a high wear resistance and high toughness, and the other monomer segment (hereinafter referred to as a "second monomer segment") that possesses low surface energy. The composite materials described herein are hybrid or copolymer compositions comprising substantially uniform, integral, interpenetrating networks of a first monomer segment and a second monomer segment, and in some embodiments, optionally a third grafted segment, wherein both the structure and the composition of the segment networks are substantially uniform when viewed through different slices of the fuser member layer. The term "interpenetrating network", in embodiments, refers to the addition polymerization matrix wherein the polymer strands of the first monomer segment and the second monomer segment, as well as those of the optional third grafted segment, are intertwined in one another. A copolymer composition, in embodiments, comprises a first monomer segment and a second monomer segment, as well as an optional third grafted segment, wherein the monomer segments are randomly arranged into a long chain molecule. Examples of polymers suitable for use as the first monomer segment or tough monomer segment include, for example, polyamides, polyimides, polysulfones, fluoroelastomers, and the like, as well as mixtures thereof. Examples of the low surface energy monomer segment or second monomer segment polymers include polyorganosiloxanes and the like, and also include intermediates that form inorganic networks. An intermediate is a precursor to inorganic oxide networks present in polymers described herein. This precursor goes through hydrolysis and condensation followed by the addition reactions to form desired network configurations of, for example, networks of metal oxides such as titanium oxide, silicon oxide, zirconium oxide, and the like; networks of metal halides; and networks of metal hydroxides. Examples of intermediates include metal alkoxides, metal halides, metal hydroxides, and polyorganosiloxanes. The preferred intermediates are alkoxides, and particularly preferred are tetraethoxy orthosilicate for silicon oxide networks and titanium isobutoxide for titanium oxide networks. In embodiments, a third low surface energy monomer segment is a grafted monomer segment and, in preferred embodiments, is a polyorganosiloxane. In these preferred embodiments, it is particularly preferred that the second monomer segment is an intermediate to a network of metal oxide. Preferred intermediates include tetraethoxy orthosilicate for silicon oxide networks and titanium isobutoxide for titanium oxide networks.

Also suitable are volume-grafted elastomers. Volume grafted elastomers are a special form of hydrofluoroelastomer, and are substantially uniform integral interpenetrating networks of a hybrid composition of a fluoroelastomer and a polyorganosiloxane, the volume graft having been formed by dehydrofluorination of fluoroelastomer by a nucleophilic dehydrofluorinating agent, followed by addition polymerization by the addition of an alkene or alkyne functionally terminated polyorganosiloxane and a polymerization initiator. Examples of specific volume graft elastomers are disclosed in, for example, U.S. Pat. Nos. 5,166,031, 5,281,506, 5,366,772, and 5,370,931, the disclosures of each of which are totally incorporated herein by reference.

Examples of suitable polymer composites include volume grafted elastomers, titamers, grafted titamers, ceramers, grafted ceramers, polyamide-polyorganosiloxane copolymers, polyimide-polyorganosiloxane copolymers, polyester-polyorganosiloxane copolymers, polysulfone-polyorganosiloxane copolymers, and the like. Titamers and grafted titamers are disclosed in, for example, U.S. Pat. No. 5,486,987, the disclosure of which is totally incorporated herein by reference; ceramers and grafted ceramers are disclosed in, for example, U.S. Pat. No. 5,337,129, the disclosure of which is totally incorporated herein by reference; and volume grafted fluoroelastomers are disclosed in, for example, U.S. Pat. No. 5,366,772, the disclosure of which is totally incorporated herein by reference. In addition, these fluoroelastomer composite materials are disclosed in U.S. Pat. No. 5,778,290, the disclosure of which is totally incorporated herein by reference.

Other polymers suitable for use herein include silicone rubbers. Suitable silicone rubbers include room temperature vulcanization (RTV) silicone rubbers, high temperature vulcanization (HTV) silicone rubbers, and low temperature vulcanization (LTV) silicone rubbers. These rubbers are known and readily available commercially, such as SILASTIC® 735 black RTV and SILASTIC® 732 RTV, both available from Dow Corning, and 106 RTV Silicone Rubber and 90 RTV Silicone Rubber, both available from General Electric. Further examples of silicone materials include Dow Corning SILASTIC® 590 and 591, Sylgard 182, and Dow Corning 806A Resin. Other preferred silicone materials include fluorosilicones, such as nonylfluorohexyl and fluorosiloxanes, including DC94003 and Q5-8601, both available from Dow Corning. Silicone conformable coatings, such as X3-6765, available from Dow Corning, are also suitable. Other suitable silicone materials include the siloxanes (preferably polydimethylsiloxanes), such as fluorosilicones, dimethylsilicones, liquid silicone rubbers (such as vinyl crosslinked heat curable rubbers or silanol room temperature crosslinked materials), and the like. Suitable silicone rubbers are available also from Wacker Silicones.

Conductive fillers can, optionally, be dispersed in the outer fusing layer of the fuser member, particularly in embodiments wherein a functional fuser oil is used. Preferred fillers are capable of interacting with the functional groups of the release agent to form a thermally stable film which releases the thermoplastic resin toner and prevents the toner from contacting the filler surface material itself. This bonding enables a reduction in the amount of oil needed to promote release. Further, preferred fillers promote bonding with the oil without causing problems such as scumming or gelling. In addition, it is preferred that the fillers be substantially non-reactive with the outer polymer material so that no adverse reaction occurs between the polymer material and the filler which would hinder curing or otherwise negatively affect the strength properties of the outer surface material. Fillers in the outer fusing layer can also increase thermal conductivity.

Other adjuvants and fillers can be incorporated in the polymer of the outer fusing layer according to the present invention, provided that they do not affect the integrity of the polymer material. Such fillers normally encountered in the compounding of elastomers include coloring agents, reinforcing fillers, processing aids, accelerators, and the like. Oxides, such as magnesium oxide, and hydroxides, such as calcium hydroxide, are suitable for use in curing many fluoroelastomers. Proton acids, such as stearic acid, are suitable additives in EPDM and BR polymer formulations to improve release by improving bonding of amino oils to the elastomer composition. Other metal oxides, such as cupric oxide, lead oxide and/or zinc oxide, can also be used to improve release. Metal oxides, such as copper oxide, aluminum oxide, magnesium oxide, tin oxide, titanium oxide, iron oxide, zinc oxide, manganese oxide, molybdenum oxide, and the like, carbon black, graphite, metal fibers and metal powder particles such as silver, nickel, aluminum, and the like, as well as mixtures thereof, can promote thermal conductivity. The addition of silicone particles to a fluoropolymer outer fusing layer can increase release of toner from the fuser member during and following the fusing process. Processability of a fluoropolymer outer fusing layer can be increased by increasing absorption of silicone oils, in particular by adding fillers such as fumed silica or clays such as organo-montmorillonites. Inorganic particulate fillers can increase the abrasion resistance of the polymeric outer fusing layer. Examples of such fillers include metal-containing fillers, such as a metal, metal alloy, metal oxide, metal salt, or other metal compound; the general classes of suitable metals include those metals of Groups 1b, 2a, 2b, 3a, 3b, 4a, 4b, 5a, 5b, 6b, 7b, 8, and the rare earth elements of the Periodic Table. Specific examples of such fillers are oxides of aluminum, copper, tin, zinc, lead, iron, platinum, gold, silver, antimony, bismuth, zinc, iridium, ruthenium, tungsten, manganese, cadmium, mercury, vanadium, chromium, magnesium, nickel, and alloys thereof. Also suitable are reinforcing calcined alumina and non-reinforcing tabular alumina.

The polymer layers of the fuser member can be coated on the fuser member substrate by any desired or suitable means, including normal spraying, dipping, and tumble spraying techniques. A flow coating apparatus as described in Copending application U.S. Ser. No. 08/672,493 filed Jun. 26, 1996, entitled "Flow Coating Process for Manufacture of Polymeric Printer Roll and Belt Components," the disclosure of which is totally incorporated herein by reference, can also be used to flow coat a series of fuser rolls. It is preferred that the polymers be diluted with a solvent, and particularly an environmentally friendly solvent, prior to application to the fuser substrate. Alternative methods, however, can be used for coating layers, including methods described in Copending application U.S. Ser. No. 09/069,476, filed Apr. 29, 1998, entitled "Method of Coating Fuser Members," the disclosure of which is totally incorporated herein by reference.

Other optional layers, such as adhesive layers or other suitable cushion layers or conductive layers, can also be incorporated between the outer polymer layer and the substrate. Optional intermediate adhesive layers and/or polymer layers can be applied to achieve desired properties and performance objectives. An adhesive intermediate layer can be selected from, for example, epoxy resins and polysiloxanes. Preferred adhesives include materials such as THIXON 403/404, Union Carbide A-1100, Dow TACTIX 740, Dow TACTIX 741, Dow TACTIX 742, Dow Corning P5200, Dow Corning S-2260, Union Carbide A-1100, and United Chemical Technologies A0728. A particularly preferred curative for the aforementioned adhesives is Dow H41. Preferred adhesive(s) for silicone adhesion are A4040 silane, available from Dow Corning Corp., Midland, Mich. 48686, D.C. 1200, also available from Dow Corning, and S-11 silane, available from Grace Specialty Polymers, Lexington, Mass. Adhesion of fluorocarbon elastomers can be accomplished with Chemlok® 5150, available from Lord Corp., Coating and Lamination Division, Erie, Pa.

Polymeric fluid release agents can be used in combination with the polymer outer layer to form a layer of fluid release agent, which results in an interfacial barrier at the surface of the fuser member while leaving a non-reacted low surface energy release fluid as an outer release film. Release agents include both functional and non-functional fluid release agents. The term "nonfunctional oil" as used herein refers to oils which do not contain organic functional groups on the backbone or pendant groups on the siloxane polymer which can react chemically with the fillers on the surface of the fuser member or the polymer matrix which comprises the top layer of the fuser member. The term "functional oil" as used herein refers to a release agent having functional groups which can react chemically with the fillers present on the surface of the fuser member or the polymer matrix which comprises the top layer of the fuser member so as to reduce the surface energy of the fillers and thereby provide better release of toner particles from the surface of the fuser member.

Preferred amino-substituted and mercapto-substituted organosiloxane polymers are of the general formula

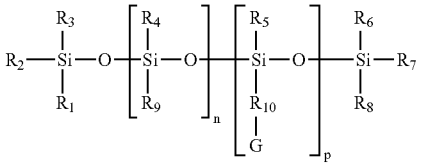

wherein G is —$NHR_{11}$ or —SH, and wherein the —$NHR_{11}$ or —SH groups can be on the same or separate chains, each of $R_1$, $R_2$, $R_3$, $R_4$, $R_5$, $R_6$, $R_7$, $R_8$, and $R_9$ independently of the others, is an alkyl group, including linear, branched, cyclic, and unsaturated alkyl groups, typically with from 1 to about 18 carbon atoms, preferably with from 1 to about 8 carbon atoms, more preferably with from 1 to about 6 carbon atoms, and even more preferably with from 1 to about 3 carbon atoms, although the number of carbon atoms can be outside of these ranges, an aryl group, including substituted aryl groups, typically with from 6 to about 18 carbon atoms, preferably with from 6 to about 10 carbon atoms, and even more preferably with from 6 to about 8 carbon atoms, although the number of carbon atoms can be outside of this range, or an arylalkyl group (with either the alkyl or the aryl portion of the group being attached to the silicon atom), including substituted arylalkyl groups, typically with from 7 to about 18 carbon atoms, preferably with from 7 to about 12 carbon atoms, and more preferably with from 7 to about 9 carbon atoms, although the number of carbon atoms can be outside of these ranges, wherein at least one of $R_4$, $R_5$, and $R_9$ can, if desired, also be a polyorganosiloxane chain with from 1 to about 100 repeat diorganosiloxane monomer units, R10 is an alkyl or arylalkyl group, the alkyl group, including linear, branched, cyclic, and unsaturated alkyl groups, typically with from 1 to about 18 carbon atoms, preferably with from 1 to about 8 carbon atoms, more preferably with from 1 to about 6 carbon atoms, even more preferably with from 1 to about 3 carbon atoms, and most preferably with about 3 carbon atoms, such as an n-propyl group, although the number of carbon atoms can be outside of these ranges, the arylalkyl group (with either the alkyl or the aryl portion of the group being attached to the silicon atom), including substituted arylalkyl groups, typically with from 7 to about 18 carbon atoms, preferably with from 7 to about 12 carbon atoms, and more preferably with from 7 to about 9 carbon atoms, although the number of carbon atoms can be outside of these ranges, and $R_{11}$, is a hydrogen atom, an alkyl group, an alkylamino group or an arylalkyl group, the alkyl group, including linear, branched, cyclic, and unsaturated alkyl groups, typically with from 1 to about 18 carbon atoms, preferably with from 1 to about 8 carbon atoms, more preferably with from 1 to about 6 carbon atoms, and even more preferably with from 1 to about 3 carbon atoms, although the number of carbon atoms can be outside of these ranges, the arylalkyl group (with either the alkyl or the aryl portion of the group being attached to the silicon atom), including substituted arylalkyl groups, typically with from 7 to about 18 carbon atoms, preferably with from 7 to about 12 carbon atoms, and more preferably with from 7 to about 9 carbon atoms, although the number of carbon atoms can be outside of these ranges. Further, p and n are each integers representing the number of repeat monomer units; typically, p is from 0 to about 5 and n is from about 50 to about 5,000, although the number of repeat monomer units can be outside of this range. In the concentrate of the present invention, the mole percent of amino or mercapto substituents typically is from about 0.2 to about 5 mole percent, although the mole percentage of functional groups can be outside of this range.

In one specific embodiment of the present invention, the mole percent of amino groups typically is from about 0.0001 mole percent to about 0.060 mole percent, and preferably about 0.003 mole percent to about 0.030 mole percent and more preferably from about 0.003 mole percent to about 0.012 mole percent, although the mole percentage of amino-functional groups can be outside of this range. In another specific embodiment of the present invention, the mole percent of mercapto substituents typically is from about 0.05 mole percent to about 1.00 mole percent, preferably from about 0.10 mole percent to about 0.20 mole percent, and more preferably from about 0.15 mole percent to 0.20 mole percent, although the mole percentage of mercapto-functional groups can be outside of this range. These numbers represent the amount of functional groups present in the fluid of this invention relative to the total number of organosiloxane groups present. It will be appreciated that in the fluid of this invention the given percentage values represent statistical averages and that some individual polymer molecules will have no functional substituents thereon, and that some individual polymer molecules may have 1, 2, 3, 4, 5, or more functional substituents thereon. In one preferred embodiment, R1, R2, R3, R4, R5, R6, R7, R8, and R9 are all methyl groups.

Examples of commercially available mercapto-or amino-functional polyorganosiloxanes include Fuser Agent®, mercapto oil (Wacker, γ-sulfhydrylpropyl substituted polydimethylsiloxane having a sulfhydryl content of about 0.20 mol %), Fuser Shield® (Wacker, γ-aminopropyl-substituted polydimethylsiloxane having an amine content of about 0.06 mol %).

The fluids of this invention typically have a viscosity at about 25° C. of from about 100 to about 1,000 centistokes, and preferably from about 250 to about 800 centistokes, although the viscosity can be outside of these ranges.

The release agents of the present invention remain fluid at temperatures typically of up to about 500° F., and preferably from about 30° F. to about 450° F., although the temperatures at which the release agents are fluid can be outside of this range.

Preferably, the release agent forms a continuous film on the polymer surface of the fuser member. The silicone oils of the present invention typically are supplied in an amount of from about 0.1 to about 50 microliters per copy (U.S. letter sized), preferably from about 2 to about 30 microliters per copy, and more preferably from about 3 to about 15 microliters per copy, although the amount can be outside of these ranges.

The release agents of the present invention exhibit desirable noninteraction with paper. They exhibit good adhesion of items such as 3M Post-It® notes to the paper, good performance of check endorser MICR inks on the paper, good performance of binding adhesives applied to the paper, and the like.

Additionally, the release agent of the invention also exhibits such advantages as increased release life times for fuser rolls such as those made of VITON® GF with filled (carbon black, boron nitride, CuO, $Al_2O_3$, etc.) overcoats, enhanced surface coverage to protect the fuser roll outer layer from toner material.

Illustrative examples of suitable toner resins for use with the present invention include vinyl polymers such as styrene polymers, acrylonitrile polymers, vinyl ether polymers, acrylate and methacrylate polymers; epoxy polymers; diolefins; polyurethanes; polyamides and polyimides; polyesters such as the polymeric esterification products of a dicarboxylic acid and a diol comprising a diphenol, crosslinked polyesters; and the like. The polymer resins selected for the toner compositions of the present invention include homopolymers or copolymers of two or more monomers. Furthermore, the above-mentioned polymer resins may also be crosslinked.

Illustrative vinyl monomer units in the vinyl polymers include styrene, substituted styrenes such as methyl styrene, chlorostyrene, styrene acrylates and styrene methacrylates; vinyl esters like the esters of monocarboxylic acids including methyl acrylate, ethyl acrylate, n-butyl-acrylate, isobutyl acrylate, propyl acrylate, pentyl acrylate, dodecyl acrylate, n-octyl acrylate, 2-chloroethyl acrylate, phenyl acrylate, methylalphachloracrylate, methyl methacrylate, ethyl methacrylate, butyl methacrylate, propyl methacrylate, and pentyl methacrylate; styrene butadienes; vinyl chloride; acrylonitrile; acrylamide; alkyl vinyl ether and the like. Further examples include p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride and vinylidene chlorofluoride; N-vinyl indole, N-vinyl pyrrolidone; and the like.

Illustrative examples of the dicarboxylic acid units in the polyester resins suitable for use in the toner compositions of the present invention include phthalic acid, terephthalic acid, isophthalic acid, succinic acid, glutaric acid, adipic acid, pimelic acid, suberic acid, azelaic acid, sebacic acid, maleic acid, furmaric acid, dimethyl glutaric acid, bromoadipic acids, dichloroglutaric acids, and the like; while illustrative examples of the diol units in the polyester resins include ethanediol, propanediols, butanediols, pentanediols, pinacol, cyclopentanediols, hydrobenzoin, bis(hydroxyphenyl)alkanes, dihydroxybiphenyl, substituted dihydroxybiphenyls, and the like.

As one toner resin, there are selected polyester resins derived from a dicarboxylic acid and a diphenol. These resins are illustrated in U.S. Pat. No. 3,590,000, the disclosure of which is totally incorporated herein by reference. Also, polyester resins obtained from the reaction of bisphenol A and propylene oxide, and in particular including such polyesters followed by the reaction of the resulting product with fumaric acid, and branched polyester resins resulting from the reaction of dimethylterephthalate with 1,3-butanediol, 1,2-propanediol, and pentaerythritol may also preferable be used. Further, low melting polyesters, especially those prepared by reactive extrusion, reference U.S. Pat. No. 5,227,460, the disclosure of which is totally incorporated herein by reference, can be selected as toner resins. Other specific toner resins may include styrene-methacrylate copolymers, styrenebutadiene copolymers, Pliolites™, and suspension polymerized styrenebutadienes (U.S. Pat. No. 4,558,108, the disclosure of which is totally incorporated herein by reference).

More preferred resin binders for use in the present invention comprise polyester resins containing both linear portions and cross-linked portions of the type described in U.S. Pat. No. 5,227,460 (incorporated herein by reference above).

The cross-linked portion of the binder consists essentially of microgel particles with an average volume particle diameter up to 0.1 micron, preferably about 0.005 to about 0.1 micron, as determined by scanning electron microscopy and transmission electron microscopy, the microgel particles being substantially uniformly distributed throughout the linear portions. This resin may be prepared by a reactive melt mixing process as known in the art. The highly cross-linked dense microgel particles distributed throughout the linear portion impart elasticity to the resin, which improves the resin offset properties, while not substantially affecting the resin minimum fix temperature.

The toner resin is thus preferably a partially cross-linked unsaturated resin such as unsaturated polyester prepared by cross-linking a linear unsaturated resin (hereinafter called base resin) such as linear unsaturated polyester resin, preferably with a chemical initiator, in a melt mixing device such as, for example, an extruder at high temperature (e.g., above the melting temperature of the resin and preferably up to about 150° C. above that melting temperature) and under high shear.

In a preferred embodiment, the cross-linked portion consists essentially of very high molecular weight microgel particles with high density cross-linking (as measured by gel content) and which are not soluble in substantially any solvents such as, for example, tetrahydrofuran, toluene and the like. The microgel particles are highly cross-linked polymers with a very small, if any, cross-link distance. This type of cross-linked polymer may be formed by reacting chemical initiator with linear unsaturated polymer, and more preferably linear unsaturated polyester, at high temperature and under high shear. The initiator molecule breaks into radicals and reacts with one or more double bond or other reactive site within the polymer chain forming a polymer radical. This polymer radical reacts with other polymer chains or polymer radicals many times, forming a highly and directly cross-linked microgel. This renders the microgel very dense and results in the microgel not swelling very well in solvent. The dense microgel also imparts elasticity to the resin and increases its hot offset temperature while not affecting its minimum fix temperature.

Linear unsaturated polyesters used as the base resin are low molecular weight condensation polymers, which may be formed by the step-wise reactions between both saturated and unsaturated diacids (or anhydrides) and dihydric alcohols (glycols or diols). The resulting unsaturated polyesters are reactive (e.g., cross-linkable) on two fronts: (i) unsaturation sites (double bonds) along the polyester chain, and (ii) functional groups such as carboxyl, hydroxy, etc., groups amenable to acid-base reactions. Typical unsaturated polyester base resins useful for this invention are prepared by melt polycondensation or other polymerization processes using diacids and/or anhydrides and diols. Suitable diacids and dianhydrides include but are not limited to saturated diacids and/or anhydrides such as for example succinic acid, glutaric acid, adipic acid, pimelic acid, suberic acid, azelaic acid, sebacic acid, isophthalic acid, terephthalic acid, hexachloroendo methylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like and mixtures thereof; and unsaturated diacids and/or anhydrides such as for example maleic acid, fumaric acid, chloromaleic acid, methacrylic acid, acrylic acid, itaconic acid, citraconic acid, mesaconic acid, maleic anhydride, and the like and mixtures thereof. Suitable diols include but are not limited to for example propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromo bisphenol dipropoxy ether, 1,4-butanediol, and the like and mixtures thereof, soluble in good solvents such as, for example, tetrahydrofiran, toluene and the like.

Preferred unsaturated polyester base resins are prepared from diacids and/or anhydrides such as, for example, maleic anhydride, acid, and the like and mixtures thereof, and diols such as, for example, propoxylated bisphenol A, propylene glycol, and the like and mixtures thereof. A particularly preferred polyester is poly(propoxylated bisphenol A fumarate).

Chemical initiators such as, for example, organic peroxides or azo-compounds are preferred for making the cross-linked toner resins of the invention. Suitable organic peroxides include diacyl peroxides such as, for example, decanoyl peroxide, lauroyl peroxide and benzoyl peroxide, ketone peroxides such as, for example, cyclohexanone peroxide and methyl ethyl ketone, alkyl peroxyesters such as, for example, t-butyl peroxy neodecanoate, 2,5-dimethyl 2,5-di (2-ethyl hexanoyl peroxy) hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di (benzoyl peroxy) hexane, oo-t-butyl o-(2-ethyl hexyl) mono peroxy carbonate, and oo-t-amyl o-(2-ethyl hexyl) mono peroxy carbonate, alkyl peroxides such as, for example, dicumyl peroxide, 2,5-dimethyl 2,5-di (t-butyl peroxy) hexane, t-butyl cumyl peroxide, bis(t-butyl peroxy) diisopropyl benzene, di-t-butyl peroxide and 2,5-dimethyl 2,5-di (t-butyl peroxy) hexyne-3, alkyl hydroperoxides such as, for example, 2,5-dihydro peroxy 2,5-dimethyl hexane, cumene hydroperoxide, t-butyl hydroperoxide and t-amyl hydroperoxide, and alkyl peroxyketals such as, for example, n-butyl 4,4-di (t-butyl peroxy) valerate, 1,1-di (t-butyl peroxy) 3,3,5-trimethyl cyclohexane, 1,1-di (t-butyl peroxy) cyclohexane, 1,1-di (t-amyl peroxy) cyclohexane, 2,2-di (t-butyl peroxy) butane, ethyl 3,3-di (t-butyl peroxy) butyrate, ethyl 3,3-di (t-amyl peroxy) butyrate and 1,1-bis(t-butyl(peroxy) 3,3,5-trimethylcyclohexane. Suitable azo-compounds include azobis-isobutyronitrile, 2,2'-azobis (isobutyronitrile), 2,2'-azobis (2,4-dimethyl valeronitrile), 2,2'-azobis (methyl butyronitrile), 1,1'-azobis (cyano cyclohexane) and other similar known compounds.

The toner resins can be subsequently melt blended or otherwise mixed with a colorant, charge carrier additives, surfactants, emulsifiers, pigment dispersants, flow additives, embrittling agents, and the like. The resultant product can then be pulverized by known methods such as milling to form toner particles. If desired, waxes with a molecular weight of from about 1,000 to about 7,000, such as polyethylene, polypropylene, and paraffin waxes, can be included in, or on the toner compositions as fusing release agents.

Various suitable colorants of any color without restriction can be employed in toners of the invention, including suitable colored pigments, dyes, and mixtures thereof including but not limited to Carbon Black, such as REGAL 330 carbon black (Cabot), acetylene black, lamp black, aniline black, CHROME YELLOW, zinc yellow, SICOFAST YELLOW, SUNBRITE YELLOW, LUNA YELLOW, NOVAPERM YELLOW, CHROME ORANGE, BAYPLAST ORANGE, cadmium red, LITHOL SCARLET, HOSTAPERM RED, FANAL PINK, HOSTAPERM PINK, LITHOL RED, RHODAMINE LAKE B, brilliant carmine, HELIOGEN BLUE, HOSTAPERM BLUE, NEOPAN BLUE, PV FAST BLUE, CINQUASSI GREEN, HOSTAPERM GREEN, HELIOGEN GREEN, titanium dioxide, cobalt, nickel, iron powder, SICOPUR 4068 FF, and iron oxides such as MAPICO BLACK (Columbia), NP608 and NP604 (Northern Pigment), BAYFERROX 8610 (Bayer), M08699 (Mobay), TMB-100 (Magnox), mixtures thereof and the like.

The colorant, for example carbon black, magnetite, or mixtures thereof, cyan, magenta, yellow, blue, green, red, orange, violet or brown, or mixtures thereof, is incorporated in an amount sufficient to impart the desired color to the toner. In general, pigment or dye is employed in an amount ranging from about 2 to about 60 percent by weight, and preferably from about 2 to about 9 percent by weight for color toner and about 3 to about 60 percent by weight for black toner.

Any suitable surface additives may be used in the present invention. Most preferred in the present invention are one or more of $SiO_2$, metal oxides such as, for example, $TiO_2$ and aluminum oxide, and a lubricating agent such as, for example, a metal salt of a fatty acid (e.g., zinc stearate, calcium stearate) or long chain alcohols such as UNILIN 700, as external surface additives. In general, silica is applied to the toner surface for toner flow, tribo enhancement, admix control, improved development and transfer stability and higher toner blocking temperature. $TiO_2$ is applied for improved relative humidity (RH) stability, tribo control and improved development and transfer stability.

For further enhancing the positive charging characteristics of the developer compositions described herein, and as optional components there can be incorporated into the toner or on its surface charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; bisulfates, and the like and other similar known charge enhancing additives. Also, negative charge enhancing additives may also be selected, such as aluminum complexes, like BONTRON E-88, and the like. These additives may be incorporated into the toner in an amount of from about 0.1 percent by weight to about 20 percent by weight, and preferably from 1 to about 3 percent by weight.

The toner composition of the present invention can be prepared by a number of known methods including melt blending the toner resin particles, and pigment particles or colorants followed by mechanical attrition. Other methods include those well known in the art such as spray drying, melt dispersion, dispersion polymerization, suspension polymerization, and extrusion.

A preferred color toner for the present invention contains a partially crosslinked propoxylated bisphenol A fumarate resin with overall gel content of 25-50%. Various colorants of any color without restriction can be employed. External surface additives include metal oxides and metal salts of fatty acids or long chain alcohols. A preferred black toner for the present invention contains a styrene based resin with carbon black as a colorant and a quaternary ammonium salt as a charge control agent.

The present invention is also directed to a process which comprises (a) generating an electrostatic latent image on an imaging member; (b) developing the latent image by contacting the imaging member with a developer; (c) transferring the developed image to a copy substrate; and (d) affixing the developed image to the copy substrate by contacting the developed image with a fuser member comprising a substrate, a layer thereover comprising a fluoropolymer, and, on the fluoropolymeric layer, a coating of a release agent comprising a mercapto-functional polyorganosiloxane blended with, preferably a lesser amount of, an amino-functional polyorganosiloxane wherein the mercapto-functional or amino-functional polyorganosiloxane is of the formula

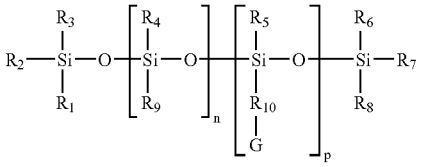

wherein G is —$NHR_{11}$ or —SH, and wherein the —$NHR_{11}$ or —SH groups can be on the same or separate chains, each of $R_1$, $R_2$, $R_3$, $R_4$, $R_5$, $R_6$, $R_7$, $R_8$, and $R_9$, independently of the others, are alkyl groups or arylalkyl groups, $R_{10}$ is an alkyl group or an arylalkyl group, $R_{11}$, is a hydrogen atom, an alkyl group, an alkylamino group or an arylalkyl group, and n and p are each integers representing the number of repeat monomer units. Preferably, the toners are polyester or styrene butadiene based toners.

Examples of suitable substrates include (but are not limited to) plain papers such as Xerox® 4024 papers, ruled notebook paper, bond paper, silica coated papers such as Sharp Company silica coated paper, Jujo paper, and the like, transparency materials, fabrics, textile products, plastics, polymeric films, inorganic substrates such as metals and wood, and the like.

The present invention also encompasses an image forming apparatus for forming images on a recording medium which comprises: a) a charge-retentive surface capable of receiving an electrostatic latent image thereon; b) a development assembly to apply toner to the charge-retentive surface, thereby developing the electrostatic latent image to form a developed image on the charge retentive surface; c) a transfer assembly to transfer the developed image from the charge retentive surface to a copy substrate; and d) a fixing assembly to fuse toner images to a surface of the copy substrate, wherein the fixing assembly includes a fuser member comprising a substrate, a layer thereover comprising a filled (CuO, $Al_2O_3$, etc.) fluoropolymer, and, on the fluoropolymeric layer, a coating of a release agent comprising a mercapto-functional polyorganosiloxane blended with lesser amounts of an amino-functional polyorganosiloxane.

Specific embodiments of the disclosure will now be described in detail in the following example. These examples are intended to be illustrative, and the disclosure is not limited to the materials, conditions, or process parameters set forth in these embodiments. All parts and percentages are by weight unless otherwise indicated.

EXAMPLE 1

A Xerox Corporation DT180 copier was retrofitted with a non-interactive development system for testing. The materials and machine conditions for nine extended life tests are given below:

EXAMPLE 1

Experimental Conditions

Toner:

Resin: Propoxylated Bisphenol-A Fumarate with 30-40% gel content

Pigment: Lithol Scarlet

Additives: silica, titania and calcium stearate

Carrier: PMMA coated steel grit

Fuser Materials:

Fuser Roll: Viton®-GF blended with copper oxide, calcined alumina, calcium hydroxide, magnesium oxide and DuPont Curative No. 50 in a mixture of methylethylketone and methylisobutylketone and overcoated on cylindrical steel roll to a nominal thickness of about 8 mils. The coated fuser member was cured by stepwise heating in air at 95° C. for 2 hours, 175° C. for 2 hours, 205° C. for 2 hours and 230° C. for 16 hours (described in U.S. Pat. No. 5,729,813).

Pressure Roll: Rigid steel cores coated with ethylene propylene diene rubber (EPDM) supplied by B. F. Goodrich under the tradename EPCAR 346 using a two-part adhesive material at the metal/rubber interface and simultaneously covered with a 20 mil PFA Teflon sleeve. This rubber had a high crosslink density after curing (described in U.S. Pat. No. 4,083,092).

Mercapto Oil (M): Xerox Fuser Agent®, 250cS, 0.2 mol % mercapto-functionalized fluid Amino Oil (A): Xerox Fuser Shield®, 350cS, 0.06 mol % amino-functionalized fluid Job Conditions:

Fuser Roll Surface Temperature: 200° C.

Paper: 8.5×14" Xerox 4024 20lb bond

Mode: Duplex

Images: 3-up checks and survey form

TMA (toner mass per unit area): ~0.8 mg/cm$^2$

TEST CONFIGURATIONS

| ID Name | Fluid Composition % Mercapto:% Amino | Test Results |
|---|---|---|
| Extended Run Test #1 | 100% M:0% A | Failed to achieve 250K. Failed due to offset conditions @ 50K prints |
| Extended Run Test #2 | 100% M:0% A | Failed to achieve 250K. Failed due to offset conditions @ 50K prints |
| Extended Run Test #3 | 50% M:50% A | Achieved 250K prints. Test suspended. No visual offset seen. |
| Extended Run Test #4 | 90% M:10% A | Achieved 250K prints. Test suspended. No visual offset seen. |
| Extended Run Test #5 | 95% M:5% A | Achieved 250K prints. Test suspended. No visual offset seen. |
| Extended Run Test #6 | 90% M:10% A | Achieved 250K prints. Test suspended. No visual offset seen. |
| Extended Run Test #7 | 90% M:10% A | Achieved 250K prints. Test suspended. No visual offset seen. |
| Extended Run Test #8 | 90% M:10% A | Achieved 250K prints. Test suspended. No visual offset seen. |
| Extended Run Test #9 | 90% M:10% A | Achieved 1,200K prints. Test suspended. No visual offset seen. |

All life testing was conducted under identical conditions except for the type of fuser fluid used. Tests 1 and 2 used 100% Fuser Agent®. Tests 3-9 employed blends of Fuser Agent® with Fuser Shield® in the ratios specified. The 50/50 ratio blended fluid contains 0.10 mole percent mercapto groups and 0.03 mole percent amino groups. The 90/10 ratio blended fluid contains 0.18 mole percent mercapto groups and 0.006 mole percent amino groups. The 95/5 ratio blended fluid contains 0.19 mole percent mercapto groups and 0.003 mole percent amino groups.

The results indicated that life tests 1 & 2 using the 100% Fuser Agent® resulted in image offset onto the fuser roll after only 250K prints. However, tests 3-8 using blended fluids produced no offset even after 250K prints, at which point each test was suspended. Additionally, test 9 demonstrated effectiveness even after 1,200K prints.

Furthermore, the fuser, pressure, donor and metering rolls from Tests 1, 3 and 4 were observed. A clear offset in the center of the Fuser Roll of Test 1 was observed after only 50K prints. See FIGS. 4-7. The fuser rolls from Tests 3 and 4 showed no toner offset, only a slight staining of the fuser roll. Consequently, no offset was seen for any of the blended fluids. Additionally, it was also noted that the higher the amine content, the less fuser roll staining was observed.

Additionally, it appeared that the blend of about 90 weight percent mercapto-functional polyorganosiloxane to about 10 weight percent amino-functional polyorganosiloxane produced advantageous results. Higher amounts of amine lead to a number of problems including feeder roll slippage and the inability to attach Post-it® notes or other adhesives to the surface of printed copies. In addition, increasing the amine content leads to evolution of increased PDMS cyclic volatiles.

EXAMPLE 2

To provide adequate release when used in combination with fluoropolymer fuser members, the amine functionality of the fuser oil blend should be sufficiently reactive with the fluoropolymer comprising the outer layer of the fuser member. At the same time, to enable Post-It® notes and adhesives to adhere to the surface of the fused paper, the amine functionality of the blend should exhibit minimal reaction with or bonding to the cellulose or fillers in paper. The reactivity of amine groups of the blends with VITON® fluoropolymer and paper was demonstrated in the following experiments.

The above tests were repeated with various blends (50/50, 85/15, 90/10, 95/5 and 100/0) of mercapto and amino-functional PMDS. The results indicated that the-use of 100% mercapto-functional PMDS produced unacceptable results (i.e., the test was stopped due to high degree of toner contamination or roll surface).

Other embodiments and modifications of the present disclosure may occur to those of ordinary skill in the art subsequent to a review of the information presented herein; these embodiments and modifications, as well as equivalents thereof, are also included within the scope of this invention.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. A fuser member comprising a substrate, a layer thereover comprising a polymer, and on the layer a coating of an organosiloxane polymer including mercapto- and amino-functionalities comprising from about 0.05 mole percent to about 1.00 mole percent mercapto groups and from about 0.0001 mole percent to about 0.06 mole percent amino groups, wherein the ratio of mercapto to amino mole percent values is at least 2.

2. A fuser member according to claim 1, wherein the polymer is a polytetrafluoroethylene, a fluorinated ethylene-propylene copolymer, polyfluoroalkoxypolytetrafluoroethylene, or mixtures thereof.

3. A fuser member according to claim 1, wherein the layer is a fluoropolymer or fluoroelastomer.

4. A fuser member according to claim 1, wherein the polymer is a copolymer of vinylidenefluoride and hexafluoropropylene; a terpolymer of vinylidenefluoride, hexafluoropropylene and tetrafluoroethylene; a tetrapolymer of vinylidenefluoride, hexafluoropropylene, tetrafluoroethylene and a cure site monomer; or a mixture thereof.

5. A fuser member according to claim 1, wherein the layer further comprises an additive selected from the group consisting of aluminum oxide, copper oxide, tin oxide, zinc oxide, lead oxide, iron oxide, platinum oxide, gold oxide, silver oxide, antimony oxide, bismuth oxide, zinc oxide, iridium oxide, ruthenium oxide, tungsten oxide, manganese oxide, cadmium oxide, mercury oxide, vanadium oxide, chromium oxide, magnesium oxide, nickel oxide, and mixtures thereof.

6. A fuser member according to claim 1, wherein the polymeric layer further comprises an additive selected from the group consisting of copper oxide, zinc oxide, and mixtures thereof.

7. A fuser member according to claim 1, wherein the coating is a blend comprising the mercapto-functional and amino-functional polyorganosiloxanes of the formula:

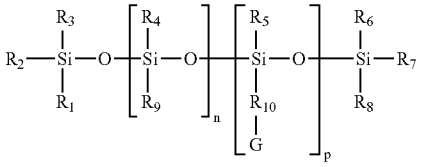

wherein G is —$NHR_{11}$ or —SH, and wherein the —$NHR_{11}$ or —SH groups can be on the same or separate chains, each of $R_1$, $R_2$, $R_3$, $R_4$, $R_5$, $R_6$, $R_7$, $R_8$, and $R_9$, independently of the others, are alkyl groups or arylalkyl groups, $R_{10}$ is an alkyl group or an arylalkyl group, $R_{11}$ is a hydrogen atom, an alkyl group, an alklyamino group or an arylalkyl group, and n and p are each integers representing the number of repeat monomer units.

8. A fuser member according to claim 1, wherein the mercapto-functional polyorganosiloxane of the coating has a weight average molecular weight of from about 4,000 to about 20,000.

9. A fuser member according to claim 1, wherein the amino-functional polyorganosiloxane of the coating has a weight average molecular weight of from about 4,000 to about 20,000.

10. A process which comprises (a) generating an electrostatic latent image on an imaging member; (b) developing the latent image by contacting the imaging member with a developer; (c) transferring the developed image to a copy substrate; and (d) affixing the developed image to the copy substrate by contacting the developed image with a fuser member according to claim 1.

11. A process according to claim 10, wherein the copy substrate is paper.

12. An image forming apparatus for forming images on a recording medium which comprises: a) a charge-retentive surface capable of receiving an electrostatic latent image thereon; b) a development assembly to apply toner to the charge-retentive surface, thereby developing the electrostatic latent image to form a developed image on the charge retentive surface; c) a transfer assembly to transfer the developed image from the charge retentive surface to a copy substrate; and d) a fixing assembly to fuse toner images to a surface of the copy substrate, wherein the fixing assembly includes a fuser member according to claim 1.

13. The image forming apparatus of claim 12, wherein the toner is a polyester based toner.

14. The image forming apparatus of claim 12, wherein the polymeric layer further comprises an additive selected from the group consisting of aluminum oxide, copper oxide, tin oxide, zinc oxide, lead oxide, iron oxide, platinum oxide, gold oxide, silver oxide, antimony oxide, bismuth oxide, zinc oxide, iridium oxide, ruthenium oxide, tungsten oxide, manganese oxide, cadmium oxide, mercury oxide, vanadium oxide, chromium oxide, magnesium oxide, nickel oxide, and mixtures thereof.

15. The image forming apparatus of claim 12, wherein the toner is a styrene butadiene based toner.

16. A fuser member comprising a substrate, a layer thereover comprising a polymer, and, on the layer, a coating of an organosiloxane polymer comprising of from about 0.10 mole percent to about 0.20 mole percent of a mercapto group and from about 0.003 to about 0.03 mole percent of amino groups, wherein the ratio of mercapto to amino mole percent values is at least 5.

17. A fuser member according to claim 16, wherein the polymer is a polytetrafluoroethylene, a fluorinated ethylene-propylene copolymer, polyfluoroalkoxypolytetrafluoroethylene, or mixtures thereof.

18. A fuser member according to claim 16, wherein the layer is a fluoropolymer.

19. A fuser member according to claim 16, wherein the polymer is a copolymer of vinylidenefluoride and hexafluoropropylene; a terpolymer of vinylidenefluoride, hexafluoropropylene and tetrafluoroethylene; a tetrapolymer of vinylidenefluoride, hexafluoropropylene, tetrafluoroethylene and a cure site monomer; or a mixture thereof.

20. A fuser member according to claim 16, wherein the layer further comprises an additive selected from the group consisting of aluminum oxide, copper oxide, tin oxide, zinc oxide, lead oxide, iron oxide, platinum oxide, gold oxide, silver oxide, antimony oxide, bismuth oxide, zinc oxide, iridium oxide, ruthenium oxide, tungsten oxide, manganese oxide, cadmium oxide, mercury oxide, vanadium oxide, chromium oxide, magnesium oxide, nickel oxide, and mixtures thereof.

21. A fuser member according to claim 16, wherein the polymeric layer further comprises an additive selected from the group consisting of copper oxide, zinc oxide, and mixtures thereof.

22. A fuser member according to claim 16, wherein the coating is a blend comprising the mercapto-functional and amino-functional polyorganosiloxanes of the formula:

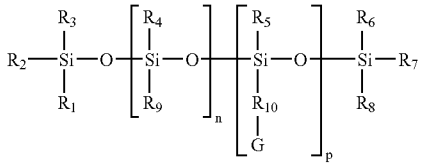

wherein G is —$NHR_{11}$ or —SH, and wherein the —$NHR_{11}$ or —SH groups can be on the same or separate chains, each of $R_1$, $R_2$, $R_3$, $R_4$, $R_5$, $R_6$, $R_7$, $R_8$, and $R_9$, independently of the others, are alkyl groups or arylalkyl groups, $R_{10}$ is an alkyl group or an arylalkyl group, $R_{11}$ is a hydrogen atom, an alkyl group, an alklyamino group or an arylalkyl group, and n and p are each integers representing the number of repeat monomer units.

23. A fuser member according to claim 16, wherein the mercapto-functional polyorganosiloxane of the coating has a weight average molecular weight of from about 4,000 to about 20,000.

24. A fuser member according to claim 16, wherein the amino-functional polyorganosiloxane of the coating has a weight average molecular weight of from about 4,000 to about 20,000.

25. A process which comprises (a) generating an electrostatic latent image on an imaging member; (b) developing the latent image by contacting the imaging member with a developer; (c) transferring the developed image to a copy substrate; and (d) affixing the developed image to the copy substrate by contacting the developed image with a fuser member according to claim 16.

26. A process according to claim 25, wherein the copy substrate is paper.

27. An image forming apparatus for forming images on a recording medium which comprises: a) a charge-retentive surface capable of receiving an electrostatic latent image thereon; b) a development assembly to apply toner to the charge-retentive surface, thereby developing the electrostatic latent image to form a developed image on the charge retentive surface; c) a transfer assembly to transfer the developed image from the charge retentive surface to a copy substrate; and d) a fixing assembly to fuse toner images to a surface of the copy substrate, wherein the fixing assembly includes a fuser member according to claim 16.

28. The image forming apparatus of claim 27, wherein the toner is a polyester based toner.

29. The image forming apparatus of claim 27, wherein the polymeric layer further comprises an additive selected from the group consisting of aluminum oxide, copper oxide, tin oxide, zinc oxide, lead oxide, iron oxide, platinum oxide, gold oxide, silver oxide, antimony oxide, bismuth oxide, zinc oxide, iridium oxide, ruthenium oxide, tungsten oxide, manganese oxide, cadmium oxide, mercury oxide, vanadium oxide, chromium oxide, magnesium oxide, nickel oxide, and mixtures thereof.

30. The image forming apparatus of claim 27, wherein the toner is a styrene butadiene based toner.

31. A fuser member comprising a substrate, a layer thereover comprising a polymer, and, on the layer, a coating of an organosiloxane polymer comprising from about 0.15 mole percent to about 0.20 mole percent mercapto groups and 0.003 mole percent to about 0.012 mole percent amino groups, wherein the ratio of mercapto to amino mole percent values is at least 10.

32. A fuser member according to claim 31, wherein the polymer is a polytetrafluoroethylene, a fluorinated ethylene-propylene copolymer, polyfluoroalkoxypolytetrafluoroethylene, or mixtures thereof.

33. A fuser member according to claim 31, wherein the layer is a fluoropolymer.

34. A fuser member according to claim 31, wherein the polymer is a copolymer of vinylidenefluoride and hexafluoropropylene; a terpolymer of vinylidenefluoride, hexafluoropropylene and tetrafluoroethylene; a tetrapolymer of vinylidenefluoride, hexafluoropropylene, tetrafluoroethylene and a cure site monomer; or a mixture thereof.

35. A fuser member according to claim 31, wherein the layer further comprises an additive selected from the group consisting of aluminum oxide, copper oxide, tin oxide, zinc oxide, lead oxide, iron oxide, platinum oxide, gold oxide, silver oxide, antimony oxide, bismuth oxide, zinc oxide, iridium oxide, ruthenium oxide, tungsten oxide, manganese oxide, cadmium oxide, mercury oxide, vanadium oxide, chromium oxide, magnesium oxide, nickel oxide, and mixtures thereof.

36. A fuser member according to claim 31, wherein the polymeric layer further comprises an additive selected from the group consisting of copper oxide, zinc oxide, and mixtures thereof.

37. A fuser member according to claim 31, wherein the coating is a blend comprising the mercapto-functional and amino-functional polyorganosiloxanes of the formula:

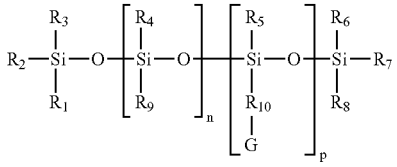

wherein G is —$NHR_{11}$ or —SH, and wherein the —$NHR_{11}$ or —SH groups can be on the same or separate chains, each of $R_1$, $R_2$, $R_3$, $R_4$, $R_5$, $R_6$, $R_7$, $R_8$, and $R_9$, independently of the others, are alkyl groups or arylalkyl groups, $R_{10}$ is an alkyl group or an arylalkyl group, $R_{11}$ is a hydrogen atom, an alkyl group, an alklyamino group or an arylalkyl group, and n and p are each integers representing the number of repeat monomer units.

38. A fuser member according to claim 31, wherein the mercapto-functional polyorganosiloxane of the coating has a weight average molecular weight of from about 4,000 to about 20,000.

39. A fuser member according to claim 31, wherein the amino-functional polyorganosiloxane of the coating has a weight average molecular weight of from about 4,000 to about 20,000.

40. A process which comprises (a) generating an electrostatic latent image on an imaging member; (b) developing the latent image by contacting the imaging member with a developer; (c) transferring the developed image to a copy substrate; and (d) affixing the developed image to the copy substrate by contacting the developed image with a fuser member according to claim 31.

41. A process according to claim 40, wherein the copy substrate is paper.

42. An image forming apparatus for forming images on a recording medium which comprises: a) a charge-retentive surface capable of receiving an electrostatic latent image thereon; b) a development assembly to apply toner to the charge-retentive surface, thereby developing the electrostatic latent image to form a developed image on the charge retentive surface; c) a transfer assembly to transfer the developed image from the charge retentive surface to a copy substrate; and d) a fixing assembly to fuse toner images to a surface of the copy substrate, wherein the fixing assembly includes a fuser member according to claim 31.

43. The image forming apparatus of claim 42, wherein the toner is a polyester based toner.

44. The image forming apparatus of claim 42, wherein the polymeric layer further comprises an additive selected from the group consisting of aluminum oxide, copper oxide, tin oxide, zinc oxide, lead oxide, iron oxide, platinum oxide, gold oxide, silver oxide, antimony oxide, bismuth oxide, zinc oxide, iridium oxide, ruthenium oxide, tungsten oxide, manganese oxide, cadmium oxide, mercury oxide, vanadium oxide, chromium oxide, magnesium oxide, nickel oxide, and mixtures thereof.

45. The image forming apparatus of claim 42, wherein the toner is a styrene butadiene based toner.

* * * * *